US005084193A

United States Patent [19]

Waynick

[11] Patent Number: 5,084,193

[45] Date of Patent: Jan. 28, 1992

[54] POLYUREA AND CALCIUM SOAP LUBRICATING GREASE THICKENER SYSTEM

[75] Inventor: John A. Waynick, Bolingbrook, Ill.

[73] Assignee: Amoco Corporation, Chicago, Ill.

[21] Appl. No.: 453,825

[22] Filed: Dec. 21, 1989

Related U.S. Application Data

[63] Continuation-in-part of Ser. No. 223,268, Jul. 22, 1988, Pat. No. 4,902,435, Ser. No. 53,262, May 22, 1987, Pat. No. 4,787,992, and Ser. No. 830,710, Feb. 18, 1986, abandoned.

[51] Int. Cl.[5] ..... C10M 125/00; C10M 135/10

[52] U.S. Cl. ..... 252/18; 252/32.5; 252/51.5 R

[58] Field of Search ..... 252/18, 32.5, 51.5 R

[56] References Cited

U.S. PATENT DOCUMENTS

| | | | |
|---|---|---|---|
| 4,107,058 | 8/1978 | Clarke et al. | 252/18 |
| 4,305,831 | 12/1981 | Johnson, III et al. | 252/18 |
| 4,440,658 | 4/1984 | Piotrowski et al. | 252/51.5 R |
| 4,787,992 | 11/1988 | Waynick | 252/18 |
| 4,902,435 | 2/1990 | Waynick | 252/18 |

*Primary Examiner*—Ferris H. Lander

*Attorney, Agent, or Firm*—Thomas W. Tolpin; William H. Magidsor; Ralph C. Medhurst

[57] ABSTRACT

A high performance lubricating grease is provided with an improved blended thickener system comprising polyurea and calcium soap.

13 Claims, 5 Drawing Sheets

POLYUREA AND CALCIUM SOAP LUBRICATING GREASE THICKENER SYSTEM

CROSS REFERENCE TO RELATED APPLICATIONS

This patent application is a continuation-in-part of the allowed patent application of John Andrew Waynick, U.S. Ser. No. 07/223,268, filed July 22, 1988, entitled, Grease with Calcium Soap and Polyurea, and now U.S. Pat. No. 4,902,435, Feb. 20, 1990 before Examiner F. H. Lander, in Group Art Unit 118, a continuation-in-part of U.S. Pat. No. 4,787,992 of John Andrew Waynick, U.S. Ser. No. 07/053,262, filed May 22, 1987, entitled Calcium-Soap Thickened Front-Wheel Drive Grease, and a continuation-in-part of the abandoned patent application of John Andrew Waynick, U.S. Ser. No. 830,710, filed Feb. 18, 1986, entitled Front-Wheel Drive Grease.

BACKGROUND OF THE INVENTION

This invention pertains to lubricants and, more particularly, to lubricating grease thickener systems.

Early lubricating greases were thickened by metal soap salts of fatty acids. Metals commonly used were sodium, calcium, aluminum, and lithium. Other metals have also been used, but with less frequency. Fatty acids included various vegetable and animal fatty acids as well as those derived from petroleum sources. In recent years, the preferred fatty acids have been hydroxylated stearic acids, most preferably 12-hydroxystearic acid.

Soaps for greases were commonly provided by reacting the metal hydroxide, oxide, carbonate, or other metallic basic compound with the fatty acid to form the corresponding fatty acid soap. This thickener formation reaction usually occurred directly in the base oil which was to be thickened. Depending on the thickener being formed, water was often used as a reaction solvent or stabilizer. If a fatty acid derivative such as an ester was used as the source, water was added to hydrolyze the derivative and free the fatty acid which could then react with the basic reagent to form the fatty acid soap. If water was not required in the final product to stabilize the thickener system, the water was generally removed by heating the grease above 212° F.

Such fatty acid soap thickeners have been used for many years and are often referred to as simple soap thickeners. Depending on the metallic base used, greases thickened by such simple soaps have dropping points of 200° F. to about 380° F. Traditionally, the dropping point of these simple soap thickened products defined the highest operating temperature by the following qualitative relationship: the highest temperature of satisfactory performance is 100° F. less than the dropping point. So, even when using a lithium soap thickened grease with a dropping point near 400° F., the maximum useful operating temperature of that grease was only about 300° F.

As severity of lubricating grease applications increased, the need for thickener systems with higher dropping points became apparent. This gave rise to the development of so-called complex soap thickeners. The complex soap thickeners most commonly used are calcium complex, lithium complex, and aluminum complex.

Lithium complex and aluminum complex greases generally have poor thermal and oxidative stability at sustained high temperatures, such as 350° F. At such temperatures, the grease rapidly degrades to a lacquer-hard material which is devoid of any lubricating properties. This so-called lacquer deposition is often considered to be the result of catastrophic oxidation of the grease and is probably promoted by the lithium complex and aluminum complex thickeners. The use of antioxidants can somewhat delay this occurrence but cannot prevent it. As long as the lithium complex or aluminum complex thickeners are present, lacquer deposition will occur. Despite their higher dropping points, lithium complex and aluminum complex greases are limited in their performance at sustained high temperatures.

Calcium complex thickened greases can also severely harden under sustained high temperatures, although usually not to the lacquer hard condition exhibited by lithium complex and aluminum complex greases. However, calcium complex greases have other problems. Even when stored at 75° F., calcium complex greases will slowly harden when exposed to air. The hardening will begin at the grease/air interface and slowly extend further into the bulk of the grease with time. This phenomenon is well known and is often referred to as skin/age hardening.

The hardening characteristics of complex soap thickened greases can cause a number of problems in actual applications. In bearing applications where the bearing is running only part of the time but experiences high temperatures during those times, such hardening effects can seriously reduce bearing life. In applications where fretting (oscillatory) motions are experienced, long term grease hardening can cause catastrophic failure due to starvation of functional lubricant.

Another problem shared by lithium complex and calcium complex greases is that of reduced thickening power of the thickener. Simple lithium soap greases with an NLGI No. 2 grade consistency will typically have a lithium soap content of 6% to 7% based on the weight of the grease. However, in lithium complex thickened greases of equivalent consistency, nearly twice the amount of thickener, 12% to 14%, based on the weight of the grease, is required. Calcium complex thickened greases show the same behavior. An NLGI No. 2 grade calcium complex grease will typically require soap levels of 16% to 18%, based on the weight of the grease, compared with about 8% for simple calcium soap thickened greases of equal consistency. One problem often associated with these higher thickener levels is that of inferior pumpability.

One thickener system which has been used with significant success as an alternative to the above complex soap thickeners is polyurea. Polyurea thickener has may fine qualities which make it a superior lubricating grease thickener compared with lithium complex, calcium complex, and aluminum complex thickeners. Polyurea does not exhibit high temperature lacquer deposition and generally has acceptable pumpability characteristics. The dropping point of polyurea is above 450° F., and usually near or above 500° F. When polyurea thickened greases exhibit their dropping point, it is due to the thickener's inability to hold the oil and not due to the polyurea melting. This is in contrast to most complex soap thickeners which melt at their dropping points.

In spite of their many favorable attributes, polyurea has several characteristics which have limited its usefulness as a lubricating grease thickener. Polyurea thickened greases retain their original consistency quite well when subjected to high shearing forces, but can soften significantly when subjected to lower shearing forces. For instance, in the 100,000 stroke penetration test, ASTM D217, polyurea greases usually soften by 60 to 100 points or more. Similar softening effects can occur when polyurea greases are subjected to the roll stability test, ASTM D1831. Polyurea thickened greases can also have oil separation characteristics which significantly increase as the temperature increases. This is a characteristic which is also exhibited by many complex soap thickened greases.

Over the years, various types of grease thickener systems and greases have been suggested. Typifying these prior art grease thickener systems and greases are those found in U.S. Pat. Nos. 2,197,263, 2,599,553, 2,898,296, 2,940,930, 3,681,242, 3,791,973, 4,107,058, 4,205,831, 4,297,227, 4,435,299, 4,440,658, 4,444,669, and 4,536,308. These prior art grease thickener systems and greases have met with varying degrees of success, but their performance has generally been limited under a varying range of conditions.

It is, therefore, desirable to provide an improved lubricating grease thickener system which overcomes most, if not all, of the above problems.

SUMMARY OF THE INVENTION

A novel lubricating thickener grease system is provided with improved lubricating properties. Among the many improved properties of the novel lubricating grease thickener systems are: shear stability, dropping point, oil separation over a wide range of temperatures, fretting wear, and thermal and oxidative stability.

In contrast to complex thickeners in prior art greases, the improved thickener system of this invention does not suffer from large loss of thickening power. Concomitant with this is an improvement in the pumpability properties.

Advantageously, greases thickened with the thickener system of this invention do not exhibit the lacquer deposition problems which are common with lithium complex and aluminum complex thickened greases. Furthermore, greases thickened with the thickener system of this invention exhibit substantially less severe high temperature hardening associated with calcium complex thickened greases. Also, skin/age hardening is greatly reduced by the novel grease thickener system.

The improved thickener system of this invention can be used in lubricating greases for a wide range of applications including both extreme pressure (EP) and antiwear (AW) conditions as well as non-EP/AW conditions. Additives commonly used in soap and non-soap thickened greases may be used with equal success in greases thickened by the improved thickener system of this application, thereby providing the grease formulator with a high degree of flexibility by which improved products can be developed.

To this end, the improved thickener system comprises a mixture of urea-containing thickener and a calcium soap thickener. The urea-containing thickener comprises monourea, diurea and/or preferably polyurea. The calcium soap thickener comprises simple calcium soap or preferably calcium complex soap. As will be discussed in greater detail below, the polyurea and calcium soap thickener components of the improved thickener system can be made separately in separate vessels as polyurea and calcium soap base greases and then mixed or they can be made in the same vessel. The synergistic properties of this improved blended thickener system are most surprising and unexpected since they substantially exceed what would logically be expected from the individual properties and characteristics of the polyurea and calcium soap thickened components.

A more detailed explanation of the invention is provided in the following description and appended claims.

DETAILED DESCRIPTION OF THE PREFERRED EMBODIMENT

Figure 1:
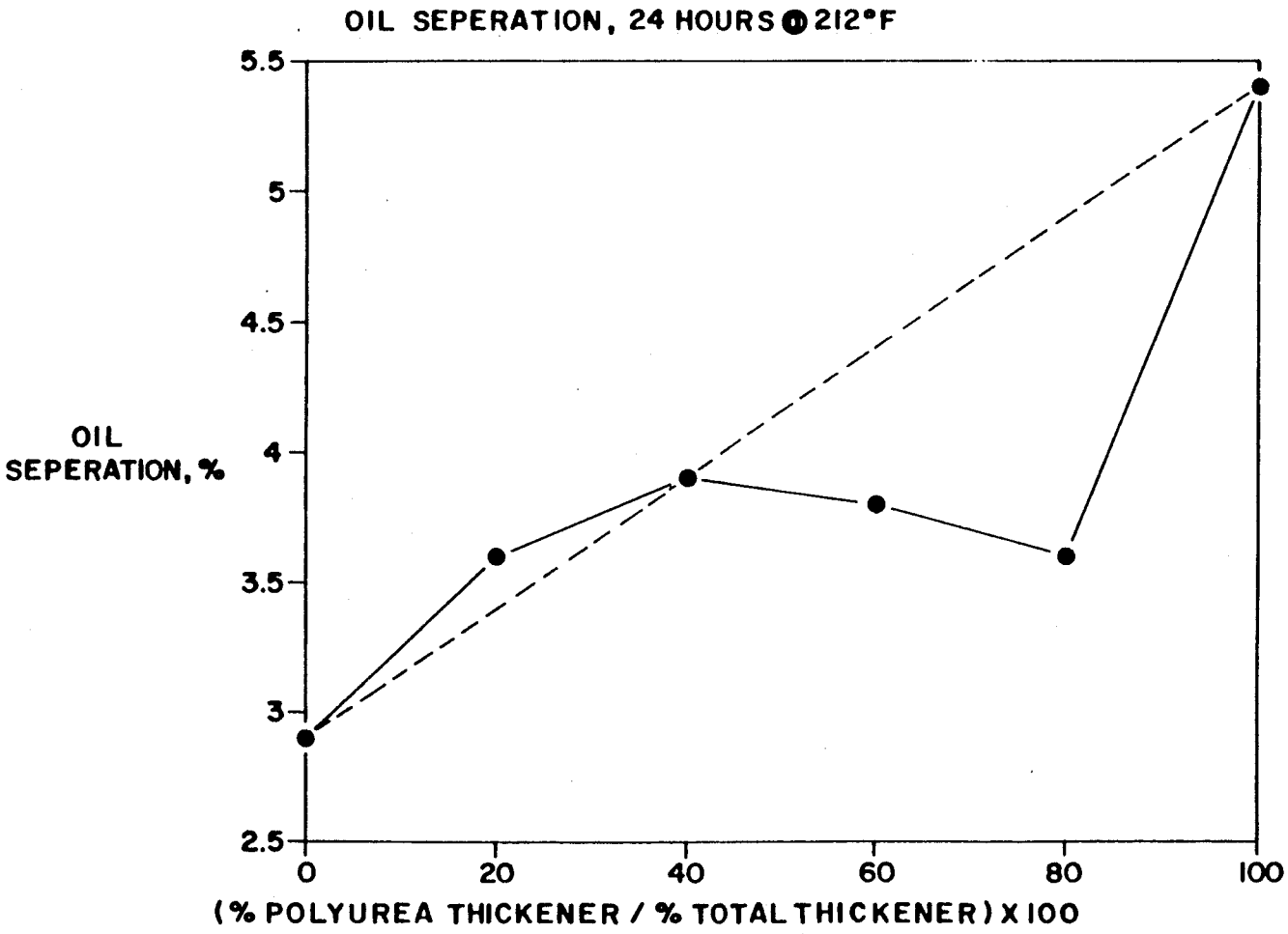
FIG. 1 is a chart of oil separation at 212° F.

The improved grease thickener system comprises a mixture and blend of polyurea and calcium soap wherein the calcium soaps are simple or complex. The improved thickener system, hereafter sometimes referred to as polyurea/calcium soap thickener, is particularly useful for providing a wide range of improvements in lubricating grease properties. Properties which are improved in greases which utilize the thickener system of this invention include: shear stability, dropping point, oil separation over a wide range of temperatures, fretting wear, and thermal and oxidative stability.

Unlike the complex thickeners previously discussed, the improved thickener system of this invention does not suffer from large loss of thickening power. Concomitant with this is a maintenance of pumpability properties. Greases thickened with the thickener system of this invention do not exhibit the lacquer deposition characteristics which are common with lithium complex and aluminum complex thickened greases. Also, the high temperature hardening associated with calcium complex thickened greases is exhibited to a much less extent or not at all when using the improved thickener system of this invention. Advantageously, skin/age hardening is also greatly reduced.

The above improved properties of the polyurea/calcium soap thickener system are most surprising and unexpected since they significantly exceed what would logically be expected from the individual properties, qualities, and characteristics of the polyurea and calcium soap thickened components. This indicates that the polyurea/calcium soap thickener system cannot be considered to be merely a mixture of polyurea and calcium soap. Instead, the thickener systems apparently interact in a way to produce the surprisingly and unexpectedly improved properties. Desirably, these improved properties can also be achieved while also reducing the processing cost of the polyurea and/or calcium soap component by a reduction in the maximum heat treatment temperature during manufacture.

Although prior art polyurea thickeners can be reacted at temperatures of 100° F. to 300° F. as discussed further below, once formed, they are often heated to nearly 400° F. to improve the overall high temperature performance properties of the resulting polyurea grease. The same heat treatment step also will often have the undesirable effect of reducing the thickening power of the resulting thickener. This results in a higher cost product since it requires a higher level of the more costly polyurea to obtain the same consistency grease. Oil separation properties can sometimes also be adversely effected by this high temperature heat treatment.

By utilizing the polyurea/calcium soap thickener technology disclosed herein it is possible to reduce or eliminate these adverse effects while also avoiding the high temperature heat treatment step. This results in a shorter manufacture time for the polyurea component which can be heated to maximum temperature of 250° F. to 300° F. instead of about 400° F. Similar reductions in the maximum heat treatment temperature for the manufacture of the calcium soap component of the polyurea/calcium soap thickener may also be attained.

The improved thickener system of this invention can be used in lubricating greases for a wide range of applications including both extreme pressure (EP) and antiwear (AW) conditions as well as non-EP/AW conditions. Additives commonly used in soap and non-soap thickened greases may be used in greases thickened by the improved thickener system of this application, thereby providing the grease formulator a high degree of flexibility by which improved products can be developed.

As will be discussed in greater detail below, the polyurea and calcium soap thickener components of the improved thickener system can be made separately in separate vessels as polyurea and calcium soap base greases and then mixed, or they can be made sequentially in the same vessel. As previously mentioned, the maximum heat treatment temperature of the polyurea and/or calcium soap component can be significantly reduced when making the polyurea/calcium soap thickener system, compared with making the separate thickener components alone. The details for these processes will be discussed in detail Polyurea The polyurea component can be prepared by several well known ways. For example, polyurea can be prepared by reacting the following components:

1. A diisocyanate or mixture of diisocyanates having the formula OCN—R—NCO, wherein R is a hydrocarbylene having from 2 to 30 carbons, preferably from 6 to 15 carbons, and most preferably 7 carbons.

2. A polyamine or mixture of polyamines having a total of 2 to 40 carbons and having the formula:

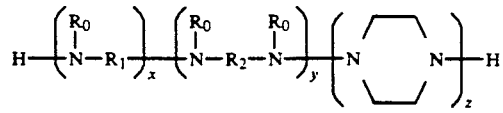

wherein $R_1$ and $R_2$ are the same or different types of hydrocarbylenes having from 1 to 30 carbons, and preferably from 2 to 10 carbons, and most preferably from 2 to 4 carbons; $R_0$ is selected from hydrogen or a C1--C4 alkyl, and preferably hydrogen; x is an integer from 0 to 4; y is 0 or 1; and z is an integer equal to 0 when y is 1 and equal to 1 when y is 0.

3. A monofunctional component selected from the group consisting of monoisocyanate or a mixture of monoisocyanates having 1 to 30 carbons, preferably from 10 to 24 carbons, a monoamine or mixture of monoamines having from 1 to 30 carbons, preferably from 10 to 24 carbons, and mixtures thereof.

The reaction can be conducted by contacting the three reactants in a suitable reaction vessel at a temperature between about 60° F. to 320° F., preferably from 100° F. to 300° F., for a period of 0.5 to 5 hours and preferably from 1 to 3 hours. The molar ratio of the reactants present can vary from 0.1-2 molar parts of monoamine or monoisocyanate and 0-2 molar parts of polyamine for each molar part of diisocyanate. When the monoamine is employed, the molar quantities can be (m+1) molar parts of diisocyanate, (m) molar parts of polyamine and 2 molar parts of monoamine. When the monoisocyanate is employed, the molar quantities can be (m) molar parts of diisocyanate, (m+1) molar parts of polyamine and 2 molar parts of monoisocyanate (m is a number from 0.1 to 10, preferably 0.2 to 3, and most preferably 1).

Mono- or polyurea compounds can have structures defined by the following general formula:

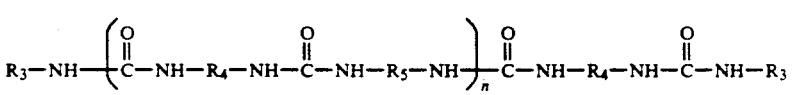

(1)

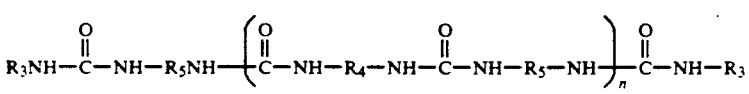

(2)

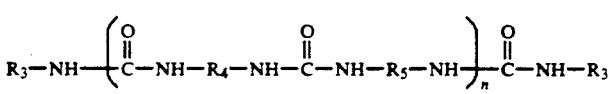

(3)

wherein n is an integer from 0 to 3; $R_3$ is the same or different hydrocarbyl having from 1 to 30 carbon atoms, preferably from 10 to 24 carbons; $R_4$ is the same or different hydrocarbylene having from 2 to 30 carbon atoms, preferably from 6 to 15 carbons; and $R_5$ is the same or different hydrocarbylene having from 1 to 30 carbon atoms, preferably from 2 to 10 carbons.

As referred to herein, the hydrocarbyl group is a monovalent organic radical composed essentially of hydrogen and carbon and may be aliphatic, aromatic, alicyclic, or combinations thereof, e.g., aralkyl, alkyl, aryl, cycloalkyl, alkylcycloalkyl, etc., and may be saturated or olefinically unsaturated (one or more double-bonded carbons, conjugated, or nonconjugated). The hydrocarbylene, as defined in $R_1$ and $R_2$ above, is a divalent hydrocarbon radical which may be aliphatic, alicyclic, aromatic, or combinations thereof, e.g., alkylaryl, aralkyl, alkylcycloalkyl, cycloalkylaryl, etc., having its two free valences on different carbon atoms.

The mono- or polyureas having the structure presented in Formula 1 above are prepared by reacting (n+1) molar parts of diisocyanate with 2 molar parts of a monoamine and (n) molar parts of a diamine. (When n equals zero in the above Formula 1, the diamine is deleted). Mono- or polyureas having the structure presented in Formula 2 above are prepared by reacting (n) molar parts of a diisocyanate with (n+1) molar parts of a diamine and 2 molar parts of a monoisocyanate. (When n equals zero in the above Formula 2, the diisocyanate is deleted). Mono- or polyureas having the structure presented in Formula 3 above are prepared by reacting (n) molar parts of a diisocyanate with (n) molar parts of a diamine and 1 molar part of a monoisocyanate and 1 molar part of a monoamine. (When n equals zero in Formula 3, both the diisocyanate and diamine are deleted).

In preparing the above mono- or polyureas, the desired reactants (diisocyanate, monoisocyanate, diamine, and monoamine) are mixed in a vessel as appropriate. The reaction may proceed without the presence of a catalyst and is initiated by merely contacting the component reactants under conditions conducive for the reaction. Typical reaction temperatures range from 70° F. to 210° F. at atmospheric pressure. The reaction itself is exothermic and, by initiating the reaction at room temperature, elevated temperatures are obtained. External heating or cooling may be used. The reaction can also be carried out in an appropriate solvent. Generally, a portion of the base oil to be used in the grease is the solvent which is used. In this way, the polyurea thickener is generated within the base oil and a grease structure is obtained as the reaction proceeds.

The monoamine or monoisocyanate used in the formulation of the mono- or polyurea can form terminal end groups. These terminal end groups can have from 1 to 30 carbon atoms, but are preferably from 5 to 28 carbon atoms, and more desirably from 10 to 24 carbon atoms. Illustrative of various monoamines are: pentylamine, hexylamine, heptylamine, octylamine, decylamine, dodecylamine, tetradecylamine, hexadecylamine, octadecylamine, eicosylamine, dodecenylamine, hexadecenylamine, octadecenylamine, octadeccadienylamine, abietylamine, aniline, toluidine, naphthylamine, cumylamine, bornylamine, fenchylamine, tertiary butyl aniline, benzylamine, beta-phenethylamine, etc. Preferred amines are prepared from natural fats and oils or fatty acids obtained therefrom. These starting materials can be reacted with ammonia to give first amides and then nitriles. The nitriles are reduced to amines by catalytic hydrogenation. Exemplary amines prepared by the method include: stearylamine, laurylamine, palmitylamine, oleylamine, petroselinylamine, linoleylamine, linolenylamine, eleostearylamine, etc. Unsaturated amines are particularly useful. Illustrative of monoisocyanates are: hexylisocyanate, decylisocyanate, dodecylisocyante, tetradecylisocyanate, hexadecylisocyanate, phenylisocyanate, cyclohexylisocyanate, xyleneisocyanate, cumeneisocyanate, abietylisocyanate, cyclooctylisocyanate, etc.

Polyamines which form the internal hydrocarbon bridges can contain from 2 to 40 carbons and preferably from 2 to 30 carbon atoms, more preferably from 2 to 20 carbon atoms. The polyamine preferably has from 2 to 6 amine nitrogens, preferably 2 to 4 amine nitrogens and most preferably 2 amine nitrogens. Such polyamines include: diamines such as ethylenediamine, propanediamine, butanediamine, hexanediamine, dodecanediamine, octanediamine, hexadecanediamine, cyclohexanediamine, cyclooctanediamine, phenylenediamine, tolylenediamine, xylylenediamine, dianiline methane, ditoluidinemethane, bis(aniline), bis(toluidine), piperazine, etc.; triamines, such as aminoethyl piperazine, diethylene triamine, dipropylene triamine, N-methyldiethylene triamine, etc., and higher polyamines such as triethylene tetraamine, tetraethylene pentaamine, pentaethylene hexamine, etc.

Representative examples of diisocyanates include: hexane diisocyanate, decanediisocyanate, octadecanediisocyanate, phenylenediisocyanate, tolylenediisocyanate, bis(diphenylisocyanate), methylene bis(phenylisocyanate), etc.

Other mono- or polyurea compounds which can be used are:

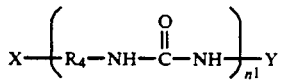

(4)

wherein $n^1$ is an integer of 1 to 3, $R_4$ is defined supra; X and Y are monovalent radicals selected from Table 1 below.

TABLE I

| X | Y |
|---|---|
| $R_7-\overset{O}{\overset{\|}{C}}-NH-$ | $R_7-\overset{O}{\overset{\|}{C}}-NH-R_5-$ |
| 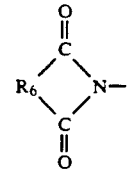 | 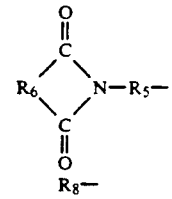 |

In Table 1, $R_5$ is defined supra, $R_8$ is the same as $R_3$ ad defined supra, $R_6$ is selected from the groups consisting of arylene radicals of 6 to 16 carbon atoms and alkylene groups of 2 to 30 carbon atoms, and $R_7$ is selected from the group consisting of alkyl radicals having from 10 to 30 carbon atoms and aryl radicals having from 6 to 16 carbon atoms.

Mono- or polyurea compounds described by formula (4) above can be characterized as amides and imides of mono-, di-, and triureas. These materials are formed by reacting, in the selected proportions, suitable carboxylic acids or internal carboxylic anhydrides with a diisocyanate and a polyamine with or without a monoamine or monoisocyanate. The mono- or polyurea compounds are prepared by blending the several reactants together in a vessel and heating them to a temperature ranging from 70° F. to 400° F. for a period sufficient to cause formation of the compound, generally from 5 minutes to 1 hour. The reactants can be added all at once or sequentially.

The above mono- or polyureas can be mixtures of compounds having structures wherein n or $n^1$ varies from 0 to 8, or n or $n^1$ varies from 1 to 8, existent within the grease composition at the same time. For example, when a monoamine, a diisocyanate, and a diamine are all present within the reaction zone, as in the preparation of ureas having the structure shown in formula (2) above, some of the monoamine may react with both sides of the diisocyanate to form diurea (biurea). In addition to the formulation of diurea, simultaneous reactions can occur to form tri-, tetra-, penta-, hexa-, octa-, and higher polyureas.

Biurea (diurea) may be used as a thickener, but it is not as stable as polyurea and may shear and loose consistency when pumped. If desired, triurea can also be included with or used in lieu of polyurea or biurea.

The polyurea component of the thickener system can also be prepared by eliminating the diamine or polyamine components described above and instead reacting the remaining two components in the presence of water. The water thereby reacts with the diisocyanate and generates a diamine component in situ. This method is often preferred since when properly used, it insures in one step the automatic elimination of excess, unreacted isocyanate moieties in the final grease. When water is used as a reactant, reaction conditions are similar to those already described above. As mentioned before, the reaction is most preferably carried out in at least a portion of the base oil to be used in the grease.

Several examples of the preparation of polyurea greases for use in the polyurea/calcium soap thickener system are given below.

EXAMPLE 1

To a laboratory grease kettle was charged 34.00 pounds of a solvent extracted, hydrotreated, paraffinic mineral oil having a viscosity of about 850 SUS at 100° F. The oil was stirred and heated until the temperature reached 170° F. Then 7.49 pounds of fatty amine sold under the brand name of Armeen T by Akzo Chemicals, Inc. were added to the kettle where it melted and mixed well with the 850 SUS oil. Then 3,500 milliliters of water was added to the kettle and the contents stirred well while heating back to 170° F. A 8.51 pound charge of Isonate 143L, a diisocyanate blend sold by Dow Chemical Company and containing predominantly 4,4'-diphenylmethane diisocyanate, was added and the kettle was closed.

The contents of the kettle were stirred for 90 minutes while maintaining the temperature around 190° F. Then hot heat transfer fluid was circulated through the kettle jacket to provide heating to the kettle contents. The polyurea base grease in the kettle was heated to 307° F. under sealed and pressurized conditions. During the heating step, the internal pressure was partially vented several times to maintain a pressure of 75 to 82 psi. Venting was accomplished via a valved port in the top of the kettle lid. When 307° F. was reached, the pressure was vented to atmospheric and the kettle was opened. During final venting, the temperature of the grease dropped to 230° F.

Upon inspection, the grease appeared to still contain some water, so the kettle was closed and the contents were heated under vacuum back to 309° F. The vacuum was then released, the kettle was opened, and 25.00 pounds were removed and stored for further processing as described in Example 2. The remaining polyurea base grease was heated to 395° F. while maintaining a nitrogen blanket over it. During this heating step, 11.37 pounds of a solvent extracted, hydrotreated, paraffinic mineral oil having a viscosity of 350° F. was slowly added to base grease while continually stirring. The polyurea base grease was held at 395° F. for 15 minutes, cooled to 200° F., and removed and stored for later use. The final composition of the polyurea base grease was:

| Component | % (wt) |
|---|---|
| 850 SUS Oil | 46.74 |
| 350 SUS Oil | 31.26 |
| Polyurea | 22.00 |

EXAMPLE 2

The 25.00 pounds of polyurea base grease removed during the production of the base grease of Example 1 was put back into the now empty grease kettle, stirred, and heated to 200° F. Then 11.37 pounds of 350 SUS oil was admixed into the polyurea base grease. The base grease was then removed and stored for later use. The final composition of the polyurea base grease was the same as that of Example 1. The only difference between the polyurea base greases of Examples 1 and 2 was the maximum heat treatment temperature.

EXAMPLES 3–4

Two polyurea greases were made by admixing the following components:

| | Weight, grams | |
|---|---|---|
| Component | Example 3 | Example 4 |
| Example 1 Base Grease | 150.00 | — |
| Example 2 Base Grease | — | 150.00 |
| 850 SUS Oil | 42.09 | 42.09 |
| 350 SUS Oil | 27.91 | 27.91 |

Each grease was stirred well and given three passes through a three-roll mill to insure a homogenous grease structure was obtained. The penetration and dropping point was obtained for both greases.

| Example No. | Example 3 | Example 4 |
|---|---|---|
| Unworked Penetration, ASTM D1403 | 331 | 307 |
| Worked Penetration, ASTM D1403 | 333 | 317 |
| Dropping Point, F, ASTM D2265 | 473 | 490 |

As can be seen, the effect of higher heat treatment of the polyurea grease was to somewhat decrease the thickening power and the dropping point.

EXAMPLE 5

To a laboratory grease kettle was charged 25.12 pounds of 850 SUS oil similar to that used in Examples 1–4. After stirring and heating the oil to 178° F., 5.15 pounds of Armeen T (fatty amine) was added. Also added was a minor amount, 250 grams of Sodium Petroleum Sulfonate HL, available from Witco Corporation. The sulfonate was added to assist in the emulsification of the water to be added. When the Armeen T (fatty amine) had melted and dissolved, 2,500 ml of water was added and allowed to mix with stirring for two minutes. Then 5.85 pounds of Mondur CD, a diisocyanate blend containing predominantly 4,4'-diphenylmethane diisocyanate and sold by Mobay Chemical Corporation, were added and allowed to mix without additional heating for 30 minutes. During this time a heavy grease-like structure quickly formed. The kettle was then closed and the grease was heated to 325° F. by circulation of hot heat exchange fluid through the kettle jacket. When the temperature of the kettle contents reached 325° F., the internal pressure was vented until atmospheric pressure was achieved. The kettle was opened. The polyurea base grease was heavy and dry. Another 13.3 pounds of 850 SUS oil was slowly added to the base grease while continuing to stir. When all the oil was well mixed into the base grease, cold heat exchange fluid was circulated through the kettle jacket. The polyurea base grease temperature was reduced to 210° F. and then removed and stored for later use. The final composition of the polyurea base grease was:

| Component | % (wt) |
|---|---|
| 850 SUS Oil | 76.90 |
| Polyurea | 22.00 |
| Sodium Petroleum Sulfonate HL | 1.10 |

EXAMPLE 6

To a laboratory grease kettle was charged 27.2 pounds of 850 SUS oil similar to that used in Examples 1-5. After stirring and heating the oil to 170 F., 5.99 pounds of Armeen T (fatty amine) was added. When the Armeen T had melted and dissolved, 3,000 ml of water was added and allowed to mix with stirring while cooling the kettle contents to 120° F. Cooling was accomplished by circulating cold heat transfer fluid through the kettle jacket. When the temperature reached 120° F., 6.81 pounds of Isonate 143L, a diisocyanate blend sold by Dow Chemical Company and containing predominantly 4,4'-diphenylmethane diisocyanate were added to the kettle and allowed to mix without additional heating for 30 minutes. During this time a heavy grease-like structure quickly formed.

The kettle was then closed and the grease was heated to 300° F. by circulation of hot heat exchange fluid through the kettle jacket. When the temperature of the kettle contents reached 300° F., the internal pressure was vented until atmospheric pressure was achieved. During the venting, the temperature of the polyurea base grease dropped to 256° F. Then a vacuum was pulled on the kettle and the contents were stirred for one hour while maintaining a temperature of about 250° F. to remove the remaining water. The kettle was then opened and 18.18 pounds of 850 SUS oil was slowly added to the dry, heavy polyurea base grease. One hour after all the oil had been added, 28.18 pounds of polyurea base grease was removed and stored for later use. The remaining 30.00 pounds of polyurea base grease was finished as a polyurea/calcium soap thickened grease as further explained in Example 49. The final composition of the polyurea base grease was:

| Component | % (wt) |
|---|---|
| 850 SUS Oil | 78.00 |
| Polyurea | 22.00 |

EXAMPLE 7

To a laboratory grease kettle was charged 30.8 pounds of 850 SUS oil similar to that used in Examples 1-6. After stirring and heating the oil to 180° F., 6.18 pounds of Armeen T was added. When the Armeen T (fatty amine) had melted and dissolved, 3,200 ml of water was added and allowed to mix with stirring while maintaining the temperature at 180° F. Temperature control was accomplished by circulating either hot or cold heat transfer fluid through the kettle jacket. When the water appeared well emulsified in the oil, 7.02 pounds of Mondur M, 4,4'-diphenylmethane diisocyanate sold by Mobay Chemical Corporation, was added to the kettle and allowed to mix out additional heating for 30 minutes. During this time a heavy grease-like structure quickly formed.

An additional 726.9 grams of 850 SUS oil was added to improve the ease of stirring of the heavy polyurea base grease. The kettle was then closed and the grease was heated to 300° F. by circulation of hot heat exchange fluid through the kettle jacket. When the temperature of the kettle contents reached 300° F., the internal pressure was vented until atmospheric pressure was achieved. During the venting, the temperature of the polyurea base grease dropped to about 250° F. Then a vacuum was pulled on the kettle and the contents were stirred and heated back to 300° F. The vacuum was subsequently released, the kettle was opened, and 14.40 pounds of 850 SUS oil was slowly added to the dry, heavy polyurea base grease. Then the polyurea base grease was heated to 395° F. and held at that temperature for 15 minutes while continuing to stir. Then the polyurea base grease was cooled to 250° F., removed, and stored for later use. The final composition of the polyurea base grease was:

| Component | % (wt) |
|---|---|
| 850 SUS Oil | 78.00 |
| Polyurea | 22.00 |

Calcium Soap

The calcium soap component of the thickener system can also be prepared in several ways. To make a calcium soap thickener requires a calcium containing base and a fatty monocarboxylic acid, ester, amide, anhydride, or other fatty monocarboxylic acid derivative. When the two materials are reacted together - usually while slurried, dispersed, or otherwise suspended in a base oil to be used in the grease, a calcium carboxylate salt, or mixture of salts is formed in the base oil. The calcium salt or salts formed thicken the oil, thereby facilitating a grease-like texture. During the reaction, water may or may not be present to assist in the formation of thickener. In earlier calcium grease technology some added water may be retained in the final calcium soap grease as "tie water." This water is required to give permanence to the grease consistency. If the grease is heated much above 212° F., the tie water is lost, and with it the grease consistency. Such hydrous calcium greases are referred to as "cup greases," and are not applicable to the subject greases.

The calcium soap thickener preferably does not require tie water, i.e. anhydrous. Anhydrous simple calcium soap thickeners are preferred because they comprise a minor to a substantial portion of monocarboxylic acids or fatty acid derivatives, preferably a hydroxyl group on one or more of the carbon atoms of the fatty chain for better stability of grease structure. The added polarity afforded by this hydroxyl group eliminates the need for tie water.

The calcium base material used in the thickener can be calcium oxide, calcium carbonate, calcium bicarbonate, calcium hydroxide, or any other calcium containing substance which, when reacted with a monocarboxylic acid or monocarboxylic acid derivative, provides a calcium carboxylate thickener.

Desirably, monocarboxylic fatty acids or their derivatives used in simple calcium soap thickeners have a moderately high molecular weight: 7 to 30 carbon atoms, preferably 12 to 30 carbon atoms, and most preferably 18 to 22 carbon atoms, such as lauric, myristic, palmitic, stearic, behenic, myristoleic, palmitoleic, oleic, and linoleic acids. Also, vegetable or plant oils such as rapeseed, sunflower, safflower, cottonseed, palm, castor and corn oils and animal oils such as fish oil, hydrogenated fish oil, lard oil, and beef oil can be used as a source of monocarboxylic acids in simple calcium soap thickeners. Various nut oils or the fatty acids derived therefrom may also be used in simple calcium soap thickeners. Most of these oils are primarily triacylglycerides. They may be reacted directly with the calcium containing base or the fatty acids may be cleaved from the triglyceride backbone, separated, and then reacted with the calcium containing base as free acids.

Hydroxy-monocarboxylic acids used in simple anhydrous calcium soap thickeners can include any counterpart to the preceding acids. The most widely used hydroxy-monocarboxylic acids are 12-hydroxystearic acid, 14-hydroxystearic acid, 16-hydroxystearic acid, 6-hydroxystearic acid and 9,10-dihydroxystearic acid. Likewise, any fatty acid derivatives containing any of the hydroxy-carboxylic acids may be used. In general, the monocarboxylic acids and hydroxy-monocarboxylic acids can be saturated or unsaturated, straight or branch chained. Esters, amides, anhydrides, or any other derivative of these monocarboxylic acids can be used in lieu of the free acids in simple anhydrous calcium soap thickeners. The preferred monocarboxylic and hydroxy-monocarboxylic acid derivative is free carboxylic acid for best results, however, other derivatives, such as those described above, can be used depending on the grease processing conditions.

When preparing simple anhydrous calcium soap thickeners by reacting the calcium base and the monocarboxylic acid, or mixture of monocarboxylic acids or derivatives thereof, it is preferred that the calcium base be added in an amount sufficient to react with all the acids and/or acid derivatives. It is also sometimes advantageous to add an excess of calcium base to more easily facilitate a complete reaction. The amount of excess calcium base depends on the severity of processing which the base grease will experience. The longer the base grease is heated and the higher the maximum heat treatment temperature, the less excess calcium base is required.

In forming the simple anhydrous calcium soap thickener, the thickener forming reaction is usually carried out at somewhat elevated temperatures, 150° F. to 320° F. Water may or may not be added to facilitate a better or more complete reaction. Preferably, any water added at the beginning of the processing as well as water formed from the thickener reaction is evaporated by heat, vacuum, or both. The thickener reaction is generally carried out after the addition of some base oil as previously described. After the thickener has been formed and any water removed, additional base oil can be added to the anhydrous base grease. During preparation, the base grease can be heat treated to a temperature ranging from about 250° F. to about 320° F. The concentration of base grease can be reduced with more base oil.

The calcium soap component of the thickener system can also be calcium complex soap. Calcium complex soap thickener comprises the same two ingredients described in the simple calcium soap case, namely, a calcium-containing base and monocarboxylic acids, at least part of which should preferably be hydroxy-monocarboxylic acids. Additionally, calcium complex soap thickeners comprise a shorter chain monocarboxylic acid. Esters, amides, anhydrides, or other carboxylic acid derivatives can also be used. The short chain fatty acid in calcium complex soap greases can have from 2 to 12 carbons, preferably 2 to 10, and most preferably 2 to 6. While the short chain acid in calcium complex soap thickener can be alkyl or aryl, unsaturated or saturated, straight chain or branched. The preferred acids are alkyl straight chain saturated acids, such as acetic acid, due to its low cost and availability. Propionic acid can also be used with similar results. Butyric, valeric, and caproic acids can be used, but are not preferred in part because of their offensive odors.

In calcium complex soap thickeners, the ratio of short chain acids to long chain acids can vary widely depending on the desired thickening power and dropping point of the calcium complex soap component of the thickener system. Since this component will be blended with polyurea to obtain the final thickener system, the relationship between individual thickener component dropping points and thickening power should be taken into account in determining the ratio of short chain acids to long chain acids. The relationship between the properties of the calcium soap and polyurea components and the final thickener system will be illustrated below in several series of examples. Generally, the lower the ratio of short chain acids to long chain acids, the less will be the dropping point elevation of the calcium complex component above that of a simple, anhydrous calcium soap grease. The larger the ratio of short chain acid to long chain acid, however, the poorer the grease thickening power of the calcium complex component because of the less effective thickening power of the calcium salt of the short chain carboxylic acid. Because of the beneficial effect on dropping point in polyurea/calcium soap thickened greases, the ratio of short chain carboxylic acids to long chain carboxylic acids can vary among any of the possible contiguous values. A polyurea/calcium soap thickened grease containing a simple calcium soap component may be considered to be the limiting case of a polyurea/calcium soap grease containing a calcium complex soap component in which the ratio of short chain to long chain carboxylic acids approaches zero.

Processing conditions for manufacture of calcium complex soap thickeners are similar to those described for simple calcium soap thickeners. An amount of the calcium base is slurried in some of the base oil. Then the long chain monocarboxylic acids and short chain carboxylic acids are added. They may be added together or separately. Water may or may not also be added. If water is added during or before formation of the thickener, then the water is preferably vaporized or otherwise removed after the thickener has been formed. This can be accomplished by heat, vacuum, or both. Once formed and dried, the calcium complex grease component can be conditioned with a heat treatment step, such as by heating the grease to a temperature ranging from about 250° F. to about 400° F., preferably, to at least about 300° F.

Several examples of the preparation of calcium soap greases for use in the polyurea/calcium soap thickener system are given below.

EXAMPLE 8

To a laboratory grease kettle was added 16.13 pounds an 850 SUS oil similar to that used in Examples 1-7. Then 1,013.7 grams of hydrated lime (calcium hydroxide) was added and stirred well to produce a smooth slurry. The slurry was then heated to 140° F. by addition of steam to the kettle jacket. When 140° F. was reached, 616.85 grams of 12-hydroxystearic acid and 1,822.61 grams of hydrogenated fatty acids were added and the temperature was increased to 170° F. The kettle contents were stirred for 30 minutes during which time a grease structure formed. Then 1,038.14 grams of glacial acetic acid was added and allowed to react without additional applied heat for 30 minutes. The kettle was then heated with full jacket steam while continuing to stir the calcium complex base grease.

When the temperature reached 240° F., electrical heating units in the kettle walls were energized with 40 amperes and heating was continued until the temperature reached 280° F. The kettle was then sealed and a vacuum was applied. The electrical heaters were boosted to 90 amperes and the kettle contents were stirred for one-half hour. Then the vacuum was released, the kettle was opened. The temperature of the calcium complex grease was 310° F. An additional 687.88 grams 850 SUS oil was slowly admixed to the calcium complex base grease. When all the oil was in and well mixed, the grease was cooled to 250° F., removed, and stored for later use.

The final composition of the calcium complex base grease was:

| Component | % (wt) |
|---|---|
| 850 SUS Oil | 78.00 |
| Calcium Complex Soap | 33.00 |
| Excess Calcium Hydroxide | 0.47 |

EXAMPLE 9

Another calcium complex grease was made using a procedure similar to that used in Example 8. The major difference was that this calcium complex base grease was heated to 340° F. under a nitrogen blanket. Instead of using just 850 SUS oil, a blend of 60% by weight of 850 SUS oil and 40% by weight 350 SUS oil was used to make this calcium complex base grease. Also, a minor amount of phenyl alpha- naphthylamine, available from Amoco Chemical Company under the brand name of Amoco 32, was added as an antioxidant. Other components and reactant ratios were the same as in Example 8. The final composition of the calcium complex base grease was:

| Component | % (wt) |
|---|---|
| 850 SUS Oil | 44.14 |
| 350 SUS Oil | 29.40 |
| Calcium Complex Soap | 26.00 |
| Excess Calcium Hydroxide | 0.37 |
| Amoco 32 | 0.09 |

EXAMPLE 10

Another calcium complex base grease was made similar to that of Example 8. The only difference was that this base grease was heated to 390° F. under a nitrogen blanket. The final composition of the calcium complex base grease was:

| Component | % (wt) |
|---|---|
| 850 SUS Oil | 75.86 |
| Calcium Complex Soap | 24.00 |
| Excess Calcium Hydroxide | 0.14 |

EXAMPLE 11

A simple anhydrous calcium soap base grease was made by the following procedure. To a laboratory grease kettle was added 4.00 pounds of 850 SUS oil similar to that used in all the preceding examples. Then 318.27 grams of hydrated lime (calcium hydroxide) was admixed to the oil to produce a smooth slurry. To this slurry was admixed 12.45 pounds of additional 850 SUS oil, 50 milliliters of water, and 2,348.24 grams of 12-hydroxystearic acid. The kettle was then shut and heated with 30 psi jacket steam for two and one-half hours. The pressure within the kettle reached 10 psi and was vented off at the end of the two and one-half hours of heating. The kettle was opened to reveal a soft base grease with a creamy consistency and obvious signs of water present. The kettle was closed again and the contents were heated with 50 psi jacket steam for one hour. At the end of this heating period the 8 psi pressure developed within the kettle was vented and the kettle was opened. The calcium soap base grease had a very firm consistency. The grease temperature was 270° F. The calcium base grease was further stirred at 280° F. for 20 minutes. Then 14.59 pounds of 850 SUS oil was slowly added and mixed into the base grease. Also added was 33.29 grams of Vanlube 848, an octylated diphenylamine antioxidant available from R. T. Vanderbilt Company, Inc. The kettle was then closed.

The calcium soap base grease was heated for one hour with 30 psi jacket steam, then for two hours with 50 psi jacket steam. The kettle was then vented to release the 8 psi internal pressure. The kettle was opened and the calcium soap base grease was heated to 290° F. An infrared spectrum of the grease revealed the absence of water. The calcium soap base grease was removed and stored for later use. The final composition of the simple anhydrous calcium soap base grease was:

| Component | % (wt) |
|---|---|
| 850 SUS Oil | 84.63 |
| Calcium 12-Hydroxystearate Soap | 15.00 |
| Vanlube 848 | 0.20 |
| Excess Calcium Hydroxide | 0.17 |

Process to Form Blended Thickener

The polyurea/calcium soap thickener system can be produced by forming each thickener component separately in different vessels as illustrated by the above examples and then mixing the resulting greases. The individual polyurea and calcium soap thickened greases can have enough base oil for the final grease, or more base oil may be added during or after the two component greases are mixed. This depends only on how concentrated the individual base greases were compared to the desired final grease composition. Generally however, the polyurea and calcium soap thickened greases are made so that the resulting polyurea/calcium soap grease has a consistency harder than required by the final grease. Then, additional additives and base oil can be added to soften the grease to its desired consistency.

Another process for making the polyurea/calcium soap thickener system is to sequentially form each thickener system in the same vessel. When this manufacturing process is used, the first thickener component is formed and a base grease thickened by that component is produced. Then the second thickener component is formed by reacting the appropriate components within the base grease thickened by the first thickener component. Generally, when this is done, enough base oil is added, either at the very beginning of the manufacturing process or after formation of the first component, so that the formation of the second thickener component does not produce a polyurea/calcium soap thickened grease too hard to stir in the reaction vessel.

When reacting the polyurea and calcium soap components sequentially in the same reaction vessel, each thickener is formed by the same procedures which are used when forming them in separate vessels. The order in which the polyurea and calcium soap components are formed is not critical; either order can be accomplished. However, it is preferable that the polyurea component be formed first for best results. This is for several reasons. First, if the calcium soap component is formed first and any free, unreacted acids remain, they may interfere with the polyurea formation reactions. Also, it has been discovered that the polyurea acts as an excellent promoter in the reaction of carboxylic acids with calcium-containing bases. This eliminates the need for adding a small amount of water when reacting the calcium component if the polyurea component is already present. The technique of sequential thickener formation within the same reaction vessel is illustrated in Examples 49 and 50.

Once both thickener systems have been sequentially formed in the same kettle, the resulting polyurea/calcium soap thickened base grease is dried by heat, vacuum, or both. Heat treatment of the resulting dry polyurea/calcium soap thickened base grease can then be accomplished. Maximum heat treatment temperature of the polyurea/calcium soap base grease, when made by sequential formation of thickener components in the same vessel, should not exceed 400° F., preferably not exceed 350° F., and most preferably not exceed 325° F. for best results.

The polyurea/calcium soap thickener system can have any proportion of the two thickener components providing that the lesser component comprises at least 1% by weight of the total thickener in the final grease. Lubricating greases thickened by the polyurea/calcium soap thickener system should have a total thickener level of preferably 6% to 20% by weight of the grease, and most preferably 10% to 16% by weight of the grease. The preferred composition of the thickener by weight is: 40% to 60% polyurea and 60% to 40% calcium soap. While the above thickener composition is preferred for best results, if desired, other amounts of polyurea and calcium soap can be used depending on the intended application and desired properties of the grease.

Base Oils

Base oils used with this thickener system can be any of the many well known base oils reported and commonly used in prior art lubricating greases. The base oil can be naphthenic oil, paraffinic oil, aromatic oil, or a synthetic oil such as a polyalphaolefin, polyester, polyolester, diester, polyalkyl ethers, polyaryl ethers, silicone polymer fluids, or combinations thereof. The viscosity of the base oil can range from 50 to 10,000 SUS at 100° F.

Other hydrocarbon oils can also be used, such as: (a) oil derived from coal products, (b) alkylene polymers, such as polymers of propylene, butylene, etc., (c) alkylene oxide-type polymers, such as alkylene oxide polymers prepared by polymerizing alkylene oxide (e.g., propylene oxide polymers, etc., in the presence of water or alcohols, e.g., ethyl alcohol), (d) carboxylic acid esters, such as those which were prepared by esterifying such carboxylic acids as adipic acid, azelaic acid, suberic acid, sebacic acid, alkenyl succinic acid, fumaric acid, maleic acid, etc., with alcohols such as butyl alcohol, hexyl alcohol, 2-ethylhexyl alcohol, etc., (e) liquid esters of acid of phosphorus, (f) alkyl benzenes, (g) polyphenols such as biphenols and terphenols, (h) alkyl biphenol ethers, and (i) polymers of silicon, such as tetraethyl silicate, tetraisopropyl silicate, tetra(4-methyl-2-tetraethyl) silicate, hexyl(4-methol-2-pentoxy) disilicone, poly(methyl)silixane, and poly(methyl)-phenylsiloxane.

Additives

Most additives used in prior art lubricating greases can be successfully used in lubricating greases thickened by the polyurea/calcium soap thickener system. The various types of additives available and their functions are generally well known and will not be describe here.

One preferred additive package, however, to attain extreme pressure (EP) properties, antiwear (AW) properties, and elastomeric compatibility comprises tricalcium phosphate and calcium carbonate. Advantageously, the use of both calcium carbonate and especially tricalcium phosphate in the additive package adsorbs oil in a manner similar to polyurea and calcium soaps and, therefore, less polyurea/calcium soap thickener is required to achieve the desired grease consistency. Typically, the cost of tricalcium phosphate and calcium carbonate are much less than polyurea and, therefore, the grease can be formulated at lower costs.

Preferably, the tricalcium phosphate and the calcium carbonate are each present in the additive package in an amount ranging from 2% to 20% by weight of the grease. For ease of handling and manufacture, the tricalcium phosphate and calcium carbonate are each most preferably present in the additive package in less than about 10% by weight of the grease. Desirably, the maximum particle sizes of the tricalcium phosphate and the calcium carbonate are 100 microns and the tricalcium phosphate and the calcium carbonate are of food-grade quality to minimize abrasive contaminants and promote homogenization. Calcium carbonate can be provided in dry solid form as $CaCO_3$. Tricalcium phosphate can be provided in dry solid form as $Ca_3(PO_4)_2$ or $3Ca_3(PO_4)_2 \cdot Ca(OH)_2$.

If desired, the calcium carbonate and/or tricalcium phosphate can be added, formed, or created in situ in the grease as byproducts of chemical reactions. For example, calcium carbonate can be produced by bubbling carbon dioxide through calcium hydroxide in the grease. Tricalcium phosphate can be produced by reacting phosphoric acid with calcium oxide or calcium hydroxide in the grease. Other methods for forming calcium carbonate and/or tricalcium phosphate can also be used.

The preferred phosphate additive is tricalcium phosphate for best results. While tricalcium phosphate is the preferred, other phosphate additives can be used, if desired, in conjunction with or in lieu of tricalcium phosphate, such as the phosphates of a Group 2a alkaline earth metal, such as beryllium, manganese, calcium, strontium, and barium, or the phosphates of a Group la alkali metal, such as lithium, sodium, and potassium.

Desirably, tricalcium phosphate is less expensive, less toxic, more readily available, safer, and more stable than other phosphates. Tricalcium phosphate is also superior to monocalcium phosphate and dicalcium phosphate. Tricalcium phosphate has unexpectedly been found to be compatible and noncorrosive with elastomers and seals of front-wheel drive joints. Tricalcium phosphate is also water insoluble and will not wash out of the grease when contamination by water occurs. Monocalcium phosphate and dicalcium phosphate, however, were found to corrode, crack, and/or degrade some elastomers and seals of front-wheel drive joints. Monocalcium phosphate and dicalcium phosphate were also undesirably found to be water soluble and wash out of the grease when the front-wheel drive joint was contacted with water, which significantly decreased the antiwear and extreme pressure qualities of the grease.

The preferred carbonate additive is calcium carbonate for best results. While calcium carbonate is preferred, other carbonate additives can be used, if desired, in conjunction with or in lieu of calcium carbonate, such as the carbonates of a Group 2a alkaline earth metal, such as beryllium, manganese, calcium, strontium, and barium.

Desirably, calcium carbonate is less expensive, less toxic, more readily available, safer, and more stable than other carbonates. Calcium carbonate is also superior to calcium bicarbonate. Calcium carbonate has been unexpectedly found to be compatible and noncorrosive with elastomers and seals of front-wheel drive joints and is water insoluble. Calcium bicarbonate, on the other hand, has been found to corrode, crack, and/or degrade many of the elastomers and seals of front-wheel drive joints. Calcium bicarbonate has also been undesirably found to be water soluble and experiences many of the same problems as monocalcium phosphate and dicalcium phosphate discussed above. Also, calcium bicarbonate is disadvantageous for another reason. During normal use, either the base oil or antioxidant additives will undergo a certain amount of oxidation. The end products of this oxidation are invariably acidic. These acid oxidation products can react with calcium bicarbonate to undesirably produce gaseous carbon dioxide. If the grease is used in a sealed application, such as a constant-velocity joint, the evolution of gaseous reaction products, such as carbon dioxides, could, in extreme cases, cause ballooning of the elastomeric seal. This would in turn place additional stress on the seal and seal clamps and could ultimately result in a seal failure and rupture. Calcium carbonate, however, is much more resistant to producing carbon dioxide, since its alkaline reserve is much higher than calcium bicarbonate.

The use of both tricalcium phosphate and calcium carbonate together in the additive package of the front-wheel drive grease was found to produce unexpected superior results in comparison to a similar grease with greater amounts by weight of: (a) tricalcium phosphate alone in the absence of calcium carbonate, or (b) calcium carbonate alone in the absence of tricalcium phosphate.

Alkali or alkaline earth metal sulfonates overbased with the corresponding alkali or alkaline earth metal carbonate and/or phosphate can also be used as the source of metal carbonate and/or phosphate. Such overbased sulfonates can also be used for emulsification, demulsification, or corrosion inhibition. They are usually liquids and are usually either oil soluble or oil dispersible to form stable mixtures. If one uses an amount of one or more of these materials sufficient to provide the requisite levels of phosphate and carbonate, as described in this invention, the resulting lubricating grease can be expected to have EP/antiwear properties equivalent to that obtained in a grease where the solid phosphate/and or carbonate was added instead. While most overbased alkali or alkaline earth metal sulfonates will work, the most preferred ones will be the ones that are most highly overbased, that is, the ones which have the highest mole ratio of carbonate and/or phosphate per sulfonate. In this way, less overbased sulfonate will be required to provide a given level of performance.

The following set of examples illustrate the surprising and unexpected benefits of the polyurea/calcium soap thickener system both with and without the presence of other additives. Also illustrated is the processes by which polyurea/calcium soap thickened greases can be made.

EXAMPLES 12-13

A finished calcium complex soap thickened grease was made in a laboratory grease kettle using a portion of the calcium complex soap base grease of Example 8. Additives and oil were added to the base grease at 250° F. and the resulting grease was stirred for one hour. Additives added were: precipitated tricalcium phosphate; precipitated calcium carbonate; Nasul BSN, a dinonylnaphthylene sulfonate rust inhibitor available from King Industries; Lubrizol 5391, a borated amine rust inhibitor available from Lubrizol Corporation; Amoco 32, a phenyl alpha-naphthylamine antioxidant available from Amoco Chemical Company; Vanlube RD, an amine-type antioxidant available from R. T. Vanderbilt Company, Inc. The temperature of the grease was then cooled to 150° F. and two portions were separately removed. One portion was given three passes through a colloid mill having a gap clearance of 0.0005 inches. The other portion was given two passes at 7,000 psi through a Gaulin homogenizer. The two greases were then evaluated by a number of laboratory tests. Grease composition and test results are given below.

| | Example 12 | Example 13 |
|---|---|---|
| Composition, % (wt) | | |
| 850 SUS Oil | 70.05 | 70.05 |
| Calcium Complex Soap | 18.25 | 18.25 |
| Tricalcium Phosphate | 5.00 | 5.00 |
| Calcium Carbonate | 5.00 | 5.00 |

-continued

| | Example 12 | Example 13 |
|---|---|---|
| Nasul BSN | 1.00 | 1.00 |
| Lubrizol 5391 | 0.50 | 0.50 |
| Amoco 32 | 0.10 | 0.10 |
| Vanlube RD | 0.10 | 0.10 |
| Method Of Milling | Colloid | Gaulin |
| Test Results | | |
| Worked Penetration, ASTM D217 | 317 | 282 |
| Dropping Point, ASTM D2265, °F. | 500+ | 500+ |
| Oil Separation, SDM 433, % Loss | | |
| 24 hr, 212° F. | 1.4 | 2.0 |
| 24 hr, 300° F. | 1.3 | 1.7 |
| 24 hr, 350° F. | 2.4 | 2.6 |
| Four Ball Wear, ASTM D2266, mm | 0.44 | 0.41 |
| Four Ball EP, ASTM D2596 | | |
| Last Nonseizure Load, Kg | 80 | 80 |
| Weld Load, Kg | 400 | 500 |
| Load Wear Index | 57.4 | 64.2 |
| Fretting Wear, ASTM D4170, 24 hr. mg loss/race set | 10.6 | 12.3 |

Oil separation was measured by SDM 433, a procedure used by Saginaw Steering Gear Division of General Motors. This procedure is similar to the widely used Federal Test Method FTM 321 except that the weight loss of grease in the 60 mesh nickel screen cone is measured to determine oil separation instead of measuring the separated oil directly. All other test methods are standard procedures widely used in the lubricating grease industry.

As can be seen, the optimum thickening power of this calcium complex soap thickened composition is achieved by using the Gaulin homogenizer. A more efficient thickener dispersion is attained using a Gaulin homogenizer when compared to typical colloid mills. However, fretting wear values are relatively high for both greases.

EXAMPLE 14

A finished polyurea grease is made in a laboratory grease kettle using a polyurea base grease similar to that of Example 5. Additives added were the same as those used in Examples 12-13. The final grease was milled in a similar fashion as Example 13 using a Gaulin Homogenizer. The final grease was evaluated by the same test procedures used in Examples 12-13. Final grease composition and test results are given below.

| | Example 14 |
|---|---|
| Composition, % (wt) | |
| 850 SUS Oil | 46.68 |
| 350 SUS Oil | 31.12 |
| Polyurea | 10.00 |
| Tricalcium Phosphate | 5.00 |
| Calcium Carbonate | 5.00 |
| Nasul BSN | 1.00 |
| Lubrizol 5391 | 0.50 |
| Sodium Petroleum Sulfonate HL | 0.50 |
| Amoco 32 | 0.10 |
| Vanlube RD | 0.10 |
| Method Of Milling | Gaulin |
| Test Results | |
| Worked Penetration, ASTM D217 | 313 |
| Dropping Point, ASTM D2265, °F. | 494+ |
| Oil Separation, SDM 433, % Loss | |
| 24 hr, 212° F. | 9.1 |
| 24 hr, 300° F. | 8.5 |
| 24 hr, 350° F. | 7.6 |
| Four Ball Wear, ASTM D2266, mm | 0.51 |
| Four Ball EP, ASTM D2596 | |
| Last Nonseizure Load, Kg | 80 |
| Weld Load, Kg | 500 |
| Load Wear Index | 66.0 |
| Fretting Wear, ASTM D4170, 24 hr. mg loss/race set | 0.2 |

Fretting wear is greatly improved in the polyurea thickened grease of this Example compared to that of either of the two similar calcium complex soap thickened greases of Examples 12-13. The thickener level is also significantly reduced. However, oil separation is higher. Although the precise dropping points of Examples 12-13 were not determined, there appears to be a reduction in dropping point for this Example compared to Examples 12-13.

EXAMPLES 15-16

Another finished grease was made by a procedure similar to that described in Examples 12-13. However, this time the grease was not derived entirely from the calcium complex base grease of Example 8. Instead, portions of the base greases of Examples 8 (calcium complex soap thickened) and Example 5 (polyurea thickened) were mixed in a laboratory grease kettle to produce a polyurea/calcium soap thickened base grease. The amounts of each component base grease were sufficient to provide equal weights of polyurea and calcium complex thickeners in the resulting polyurea/calcium soap base grease. Additives and oil were then admixed in a manner similar to that done in Examples 12-13. The resulting finished grease was then divided into two portions and milled using the same two procedures as was used in Examples 12-13. Final greases were then evaluated by the same test procedures used in Examples 12-13. Final grease compositions and test results are given below.

| | Example 15 | Example 16 |
|---|---|---|
| Composition, % (wt) | | |
| 850 SUS Oil | 74.63 | 74.63 |
| Polyurea | 6.63 | 6.63 |
| Calcium Complex Soap | 6.62 | 6.62 |
| Tricalcium Phosphate | 5.00 | 5.00 |
| Calcium Carbonate | 5.00 | 5.00 |
| Nasul BSN | 1.00 | 1.00 |
| Lubrizol 5391 | 0.50 | 0.50 |
| Sodium Petroleum Sulfonate HL | 0.33 | 0.33 |
| Amoco 32 | 0.10 | 0.10 |
| Vanlube RD | 0.10 | 0.10 |
| Excess Calcium Hydroxide | 0.09 | 0.09 |
| Method Of Milling | Colloid | Gaulin |
| Test Results | | |
| Worked Penetration, ASTM D217 | 307 | 308 |
| Dropping Point, ASTM D2265, °F. | 500+ | 500+ |
| Oil Separation, SDM 433, % Loss | | |
| 24 hr, 212° F. | 1.7 | 1.8 |
| 24 hr, 300° F. | 1.5 | 0.6 |
| 24 hr, 350° F. | 1.6 | 1.0 |
| Four Ball Wear, ASTM D2266, mm | 0.41 | 0.42 |
| Four Ball EP, ASTM D2596 | | |
| Last Nonseizure Load, Kg | 80 | 80 |
| Weld Load, Kg | 500 | 620 |
| Load Wear Index | 63.0 | 65.9 |
| Fretting Wear, ASTM D4170, 24 hr. mg loss/race set | 1.6 | 0.4 |

The primary, significant compositional difference between Examples 12-13, Example 14, and Examples 15-16 is the thickeners used. Comparison of the test results shows that oil separation for the polyurea/calcium soap thickened greases of Examples 15-16 are equivalent or superior to the calcium complex soap thickened greases of Examples 12-13 and superior to the polyurea thickened grease of Example 14. This is despite the fact that the thickener system of Examples 15-16 was made by mixing polyurea and calcium complex soap thickeners.

Also, the fretting wear performance of Examples 15-16 show substantial improvement when compared to the fretting wear performance of Examples 12-13 and Example 14. Although the thickener system of Examples 15-16 are equal weight mixtures of polyurea and calcium complex, the fretting wear performance of Examples, 15 and 16 are nearly equal to that of Example 14 and greatly exceed that of Examples 12-13. These substantial performance improvements of the polyurea/calcium soap thickened greases of Examples 15-16 are achieved by an unexpected synergistic interaction of polyurea and calcium soap. Such results could not be reasonably predicted by mixing polyurea and calcium complex soap.

Another surprising and unexpected benefit of the polyurea/calcium soap thickened greases of Examples 15-16 is the thickening power obtained by colloid milling. The achieved thickening power of Example 15 (Colloid milled) is equivalent to Example 16 (Gaulin milled) since worked penetration is essentially equivalent. This is surprising since Gaulin milling gave significant improvement over colloid milling in Examples 12-13. The greatly lowered total thickener level of the polyurea/calcium soap thickened greases of Examples 15-16 when compared to Examples 12-13 are achieved regardless whether milling is accomplished by Gaulin homogenizer or colloid mills. This is important since throughput rates for colloid mills are generally far greater than Gaulin homogenizers. Also, maintenance costs for Gaulin homogenizers are usually much higher than colloid mills.

The following series of Examples further illustrate the surprising and unexpected improvements of polyurea/calcium soap thickener systems in greases which contain substantially no additives.

EXAMPLES 17-22

A series of six polyurea/calcium soap thickened greases were made using the polyurea base grease of Example 1 and the calcium complex base grease of Example 9. The total thickener level for all six greases was held constant at 18% by weight. Base oil additions were made using 850 SUS Oil and 350 SUS Oil in amounts sufficient to maintain a blend of 60% by weight 850 SUS Oil and 40% by weight 350 SUS Oil in all six greases. The only additive present was a very small level of Amoco 32 antioxidant which was contained in the calcium complex soap thickened base grease of Example 9. All six greases were stirred well by hand using a steel spatula and then given three passes through a three-roll mill to assure a homogenous grease structure. The three-roll mill gap setting was 0.002 inch. The six greases were evaluated for worked penetration and oil separation properties. Compositional information and test results are given below.

| | Examples | | | | | |
|---|---|---|---|---|---|---|
| | 17 | 18 | 19 | 20 | 21 | 22 |
| Ingredients Added, grams | | | | | | |
| Example 1 Base Grease | — | 29.55 | 78.79 | 88.64 | 118.18 | 100.00 |
| Example 9 Base Grease | 100.00 | 100.00 | 100.00 | 50.00 | 25.00 | — |
| 850 SUS Oil | 26.67 | 30.61 | 37.17 | 25.15 | 22.42 | 13.33 |
| 350 SUS Oil | 17.78 | 20.40 | 24.78 | 16.77 | 14.95 | 8.89 |
| Final Composition, % (wt) | | | | | | |
| 850 SUS Oil | 49.01 | 49.05 | 49.09 | 49.12 | 49.16 | 49.20 |
| 350 SUS Oil | 32.67 | 32.70 | 32.72 | 32.75 | 32.78 | 32.80 |
| Polyurea | — | 3.60 | 7.20 | 10.80 | 14.40 | 18.00 |
| Calcium Complex Soap | 18.00 | 14.40 | 10.80 | 7.20 | 3.60 | — |
| Excess Calcium Hydroxide | 0.26 | 0.20 | 0.15 | 0.10 | 0.05 | — |
| Amoco 32 | 0.06 | 0.05 | 0.04 | 0.03 | 0.01 | — |
| Test Results | | | | | | |
| Worked Penetration, ASTM D217 | 333 | 345 | 321 | 319 | 311 | 291 |
| Oil Separation, FTM 321, % Loss | | | | | | |
| 24 hr, 212° F. | 2.9 | 3.6 | 3.9 | 3.8 | 3.6 | 5.4 |
| 24 hr, 300° F. | 5.5 | 3.7 | 1.7 | 2.8 | 3.4 | 6.5 |
| 24 hr, 350° F. | 6.5 | 3.6 | 2.9 | 2.0 | 4.5 | 7.8 |

The synergistic substantial improvement in oil separation resulting from the polyurea/calcium soap thickener is clearly seen from the test results. These results are also graphically displayed in the charts of FIGS. 1-3. The solid lines in the charts show the actual performance data. The dotted lines in the charts show expected data based upon a thickener consisting of 100% polyurea and a thickener containing no polyurea.

Figure 2:
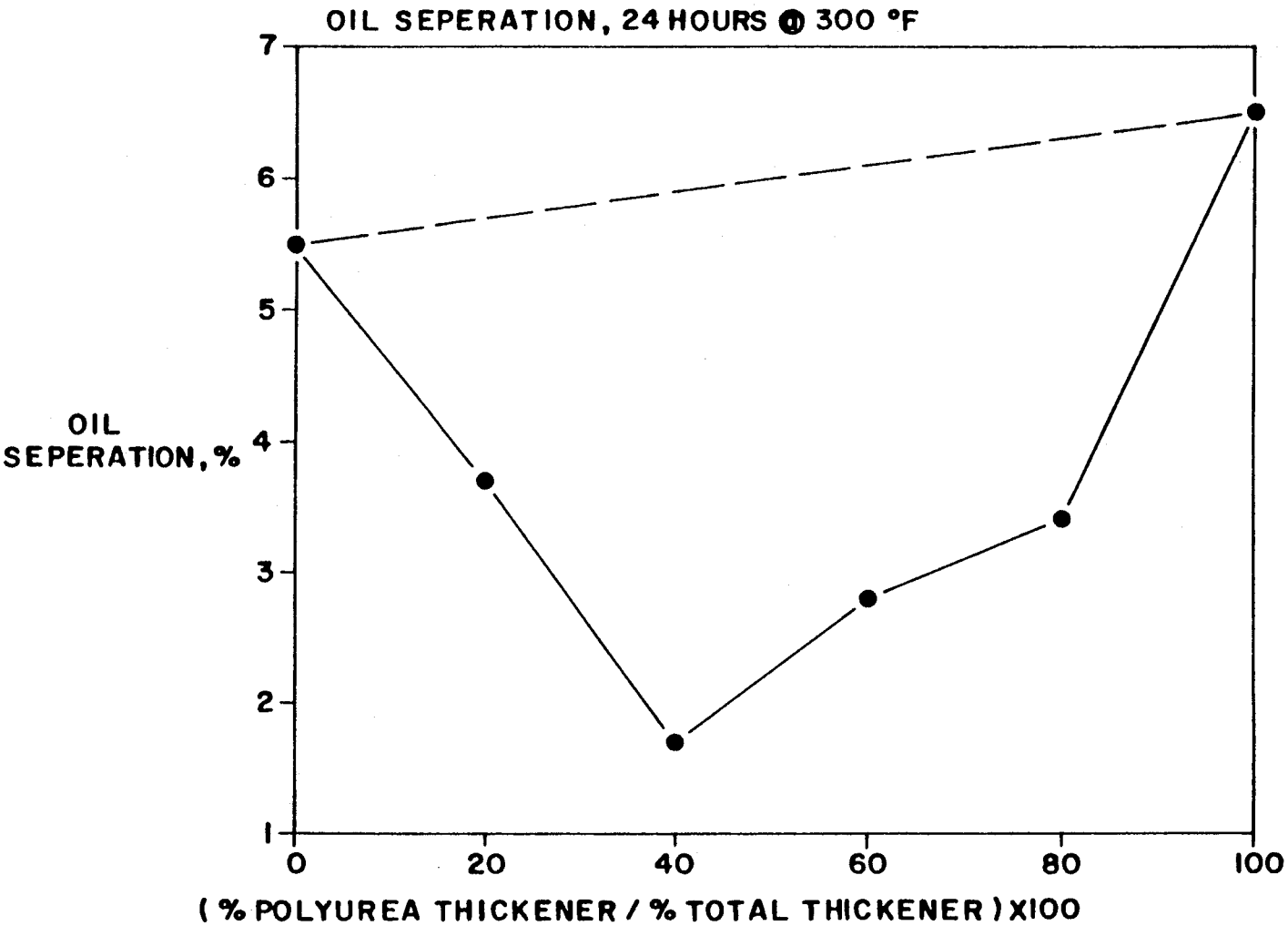
FIG. 2 is a chart of oil separation at 300° F.
Figure 3:
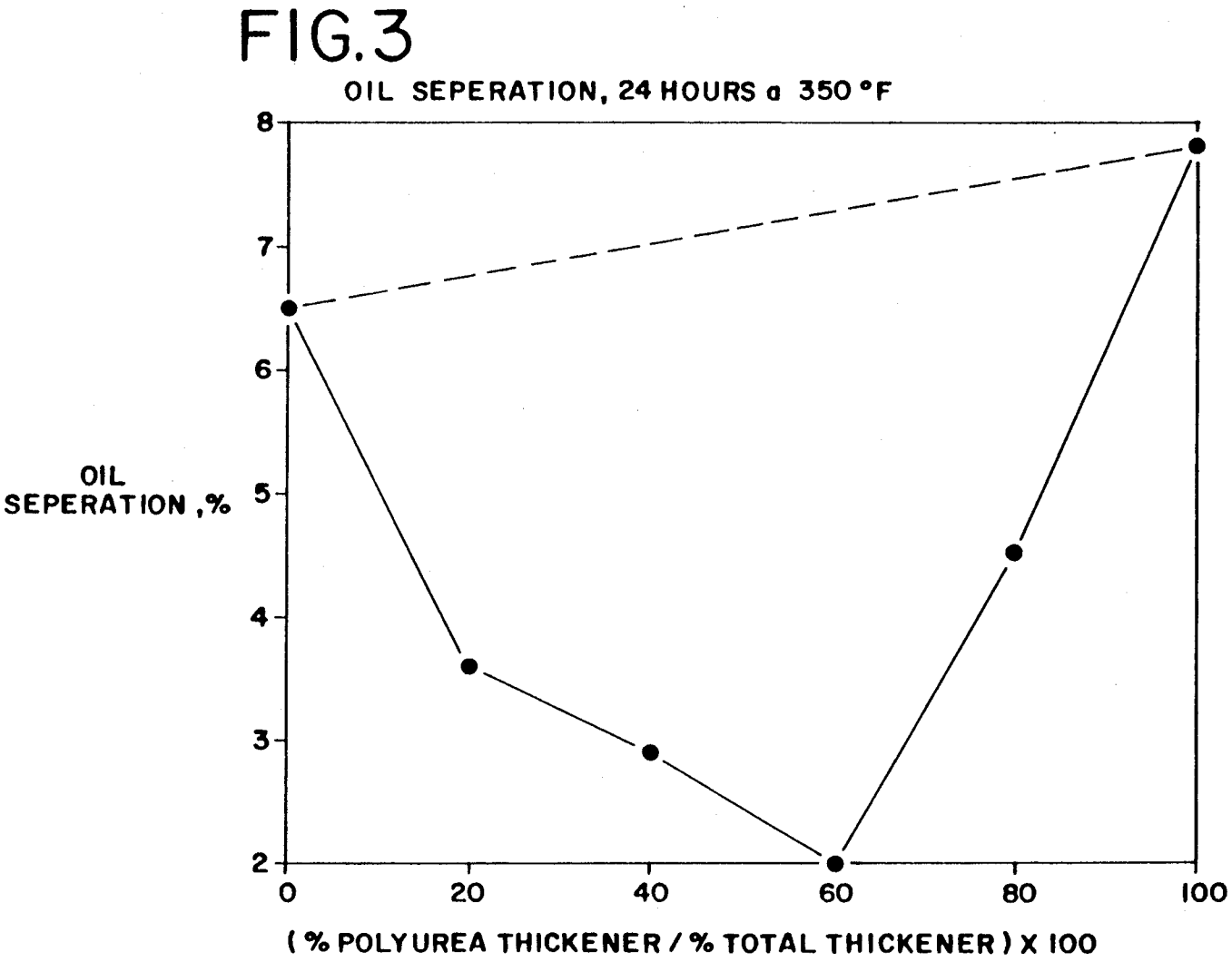
FIG. 3 is a chart of oil separation at 350° F.

As can be seen from FIGS. 1-3, the magnitude of oil separation improvement increases as test temperature increases. This result is even more remarkable since most of the polyurea/calcium soap thickened greases are softer than the calcium soap grease of Example 17 or the polyurea thickened grease of Example 22. Once again, test results confirm that the polyurea/calcium soap thickener system provides unexpected surprisingly good results. An interactive effect is apparently causing the surprising and unexpected improvements.

EXAMPLES 23-30

To a laboratory grease kettle was added 15.00 pounds of the calcium complex soap thickened base grease of Example 10. The grease was stirred and heated to 170° F. and 2,270.0 grams of 850 SUS oil was admixed. The calcium soap thickener level was thereby reduced to 18.00% by weight. The entire grease was removed and given two passes through a Gaulin homogenizer at 7,000 psi. The temperature of the grease entering the Gaulin homogenizer was 150° F. for both passes. The resulting grease was then weighed back into a clean laboratory grease kettle and stirred under vacuum for 15 minutes at 160° F. Then a carefully weighed portion was removed and given one additional pass through the Gaulin homogenizer at 7,000 psi. The temperature of the grease entering the Gaulin homogenizer was 160° F. The milled grease was stored in a sealed container for later evaluation. The weight of the remaining grease in the kettle was exactly known since a precise amount had been removed.

An amount of 850 SUS oil was admixed to the grease in the kettle to bring the calcium complex soap thickener level to 17.50% by weight. After the oil was well mixed, the grease was stirred under vacuum for 15 minutes at 160° F. A weighted portion was then removed, given one pass through the Gaulin Homogenizer at 7,000 psi, and stored in a sealed container for later evaluation. Additional additions of 850 SUS oil and sample removals were accomplished in a like manner to obtain a series of samples all of which had been milled under exactly the same conditions. Also, the compositions of all the greases were known, due to the precise method by which oil was added and grease samples were removed.

The eight samples generated by this procedure were evaluated for unworked and worked penetration. To maximize the accuracy of the worked penetration results, each grease was so measured six times. One grease was also evaluated for dropping point. Another grease was evaluated for skin/age hardening by carefully removing the previously undisturbed top inch after one month of storage at 77° F. The unworked and worked penetrations of this portion were then taken as a measure of the skin/age hardening. Grease compositions and test results are given below.

| | Examples | | | | | | | |
|---|---|---|---|---|---|---|---|---|
| | 23 | 24 | 25 | 26 | 27 | 28 | 29 | 30 |
| Composition, % (wt) | | | | | | | | |
| 850 SUS Oil | 81.90 | 82.40 | 82.90 | 83.40 | 83.91 | 84.41 | 84.91 | 85.92 |
| Calcium Complex Soap | 18.00 | 17.50 | 17.00 | 16.50 | 16.00 | 15.50 | 15.00 | 14.00 |
| Excess Calcium Hydroxide | 0.10 | 0.10 | 0.10 | 0.10 | 0.09 | 0.09 | 0.09 | 0.08 |
| Test Results | | | | | | | | |
| Unworked Penetration, ASTM D217 | 249 | 255 | 271 | 276 | 281 | 289 | 303 | 319 |
| Worked Penetration, ASTM D217 | | | | | | | | |
| Replicate results | 290 | 295 | 301 | 311 | 322 | 326 | 335 | 351 |
| | 285 | 292 | 301 | 305 | 316 | 328 | 334 | 350 |
| | 284 | 293 | 298 | 305 | 320 | 326 | 331 | 348 |
| | 291 | 286 | 302 | 309 | 321 | 329 | 337 | 346 |
| | 290 | 288 | 302 | 309 | 316 | 327 | 334 | 348 |
| | 291 | 291 | 303 | 311 | 319 | 327 | 333 | 348 |
| Average | 289 | 291 | 301 | 308 | 319 | 327 | 334 | 349 |
| Dropping Point, ASTM D2265, °F. | — | — | 638 | — | — | — | — | — |
| Skin/Age Hardening After 1 Month | | | | | | | | |
| Unworked Penetration, ASTM D1403 | — | — | — | — | 179 | — | — | — |
| Unworked Change | — | — | — | — | −102 | — | — | — |
| Worked Penetration, ASTM D1403 | — | — | — | — | 290 | — | — | — |
| Worked Change | — | — | — | — | −29 | — | — | — |

Figure 4:
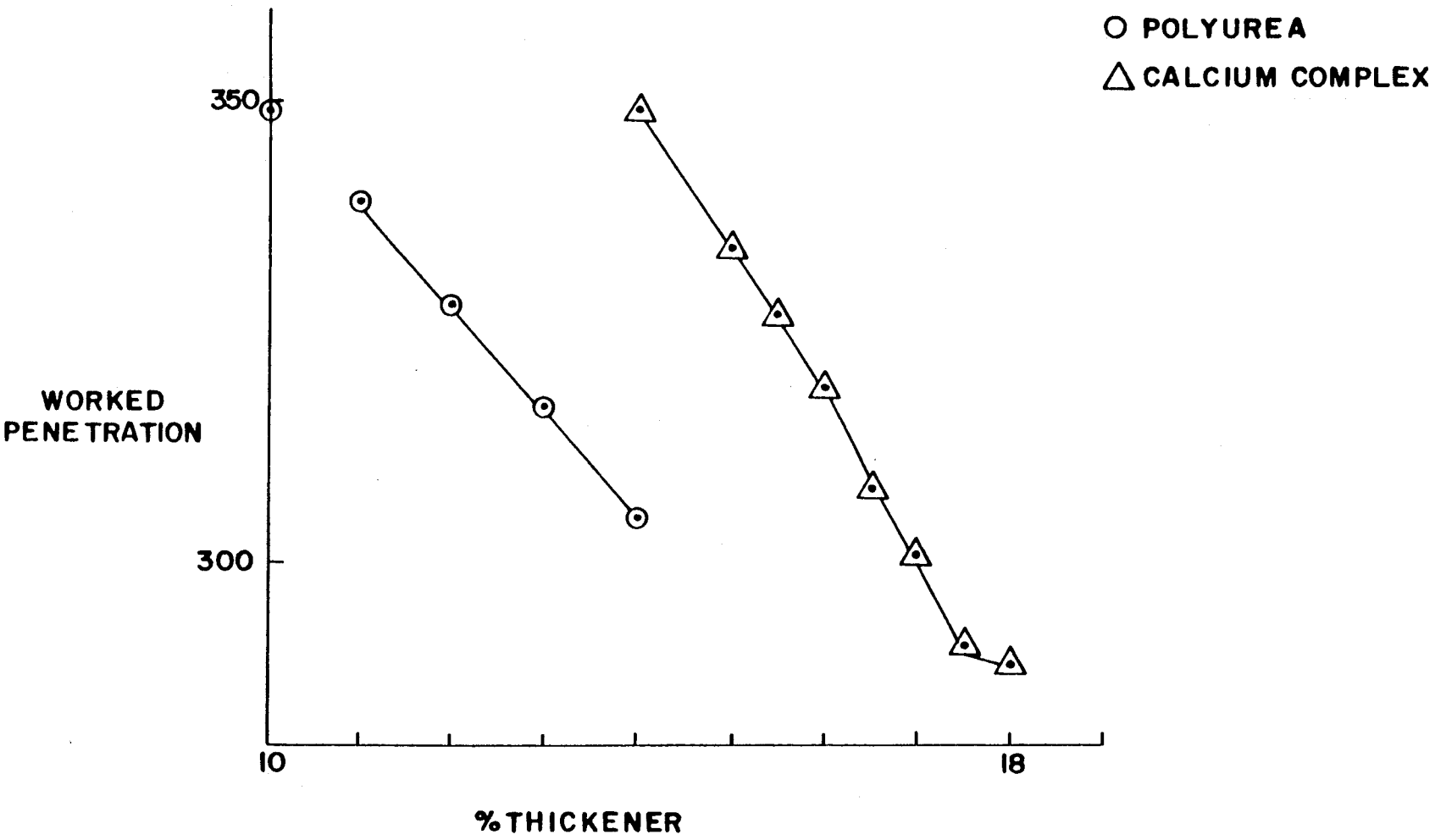
FIG. 4 is a chart of work penetration of a polyurea thickened grease and a calcium thickened grease.

A graphical display of worked penetration as a function of calcium complex soap content for the greases of Examples 23-30 is shown in the chart of FIG. 4. This graph (chart) illustrates the worked penetration and thickening power of the calcium complex soap in the 850 SUS oil.

EXAMPLES 31-35

To a laboratory grease kettle was added 9.00 pounds of the polyurea thickened base grease of Example 6. The base grease was stirred and heated to 170° F. and then 2,334.86 grams of 850 SUS oil was slowly admixed thereby reducing the polyurea thickener level to 14.00% by weight. By using a procedure identical in design to that of Examples 23-30, another series five of grease were made with accurately known compositions and descending polyurea thickener levels. All five greases had been given three passes through the Gaulin homogenizer with milling conditions identical to that experienced by Examples 23-30. The five polyurea greases were evaluated by the same test procedures used in Examples 23-30. Because of the high degree of agreement in replicate worked penetration values, only three replicates were taken for the five polyurea thickened greases. Grease compositions and test results are given below.

| | Examples | | | | |
|---|---|---|---|---|---|
| | 31 | 32 | 33 | 34 | 35 |
| Composition, % (wt) | | | | | |
| 850 SUS Oil | 86.00 | 87.00 | 88.00 | 89.00 | 90.00 |
| Polyurea | 14.00 | 13.00 | 12.00 | 11.00 | 10.00 |
| Test Results | | | | | |
| Unworked Penetration, ASTM D217 | 263 | 281 | 292 | 311 | 319 |
| Worked Penetration, ASTM D217 | | | | | |
| Replicate results | 305 | 317 | 328 | 338 | 347 |
| | 305 | 316 | 328 | 340 | 350 |
| | 306 | 317 | 328 | 340 | 350 |
| Average | 305 | 317 | 328 | 339 | 349 |
| Dropping Point, ASTM D2265, °F. | 462 | — | — | — | — |
| Skin/Age Hardening After 1 Month | | | | | |
| Unworked Penetration, ASTM D1403 | — | 289 | — | — | — |
| Unworked Change | — | +8 | — | — | — |
| Worked Penetration, ASTM D1403 | — | 307 | — | — | — |
| Worked Change | — | −10 | — | — | — |

A graphical display of worked penetration as a function of polyurea content for the greases of Examples 31-35 is also shown in the graph (chart) given in FIG. 4. This graph illustrates the worked penetration and thickening power of the polyurea in the 850 SUS oil.

EXAMPLES 36–40

To a laboratory grease kettle was added 2,465.91 grams of the polyurea thickened base grease of Example 6 and 2,260.42 grams of the calcium complex soap thickened base grease of Example 10. The two base greases were stirred and heated to 170° F. Then 2,273.67 grams of 850 SUS oil was admixed to reduce the total polyurea/calcium soap thickener level to 15.50% by weight with a 1/1 by weight ratio of polyurea to calcium complex soap. By using a procedure identical in design to that of Examples 23–30 and Examples 31–35, another series of five greases were made with accurately known compositions and descending polyurea/calcium soap thickener levels. All five greases had been given three passes through the Gaulin homogenizer with milling conditions identical to that experienced by Examples 23–30 and Examples 31–35. The five polyurea greases were evaluated by the same test procedures used in Examples 23–30 and Examples 31–35. Grease compositions and test results are given below.

| | Examples | | | | |
|---|---|---|---|---|---|
| | 36 | 37 | 38 | 39 | 40 |
| Component, % (wt) | | | | | |
| 850 SUS Oil | 84.45 | 85.46 | 86.46 | 87.46 | 88.47 |
| Polyurea | 7.75 | 7.25 | 6.75 | 6.25 | 5.75 |
| Calcium Complex Soap | 7.75 | 7.25 | 6.75 | 6.25 | 5.75 |
| Excess Calcium Hydroxide | 0.05 | 0.04 | 0.04 | 0.04 | 0.03 |
| Test Results | | | | | |
| Unworked Penetration, ASTM D217 | 265 | 280 | 291 | 304 | 320 |
| Worked Penetration, ASTM D217 | | | | | |
| Replicate results | 298 | 315 | 329 | 339 | 352 |
| | 296 | 315 | 328 | 341 | 350 |
| | 298 | 312 | 328 | 337 | 350 |
| | 298 | 315 | 327 | 340 | 353 |
| | 299 | 315 | 328 | 339 | 352 |
| Average | 298 | 314 | 328 | 339 | 351 |
| Dropping Point, ASTM D2265, °F. | 634 | — | — | — | — |
| Skin/Age Hardening After 1 Month | | | | | |
| Unworked Penetration, ASTM D1403 | — | 264 | — | — | — |
| Unworked Change | — | −16 | — | — | — |
| Worked Penetration, ASTM D1403 | — | 299 | — | — | — |
| Worked Change | — | −15 | — | — | — |

Figure 5:
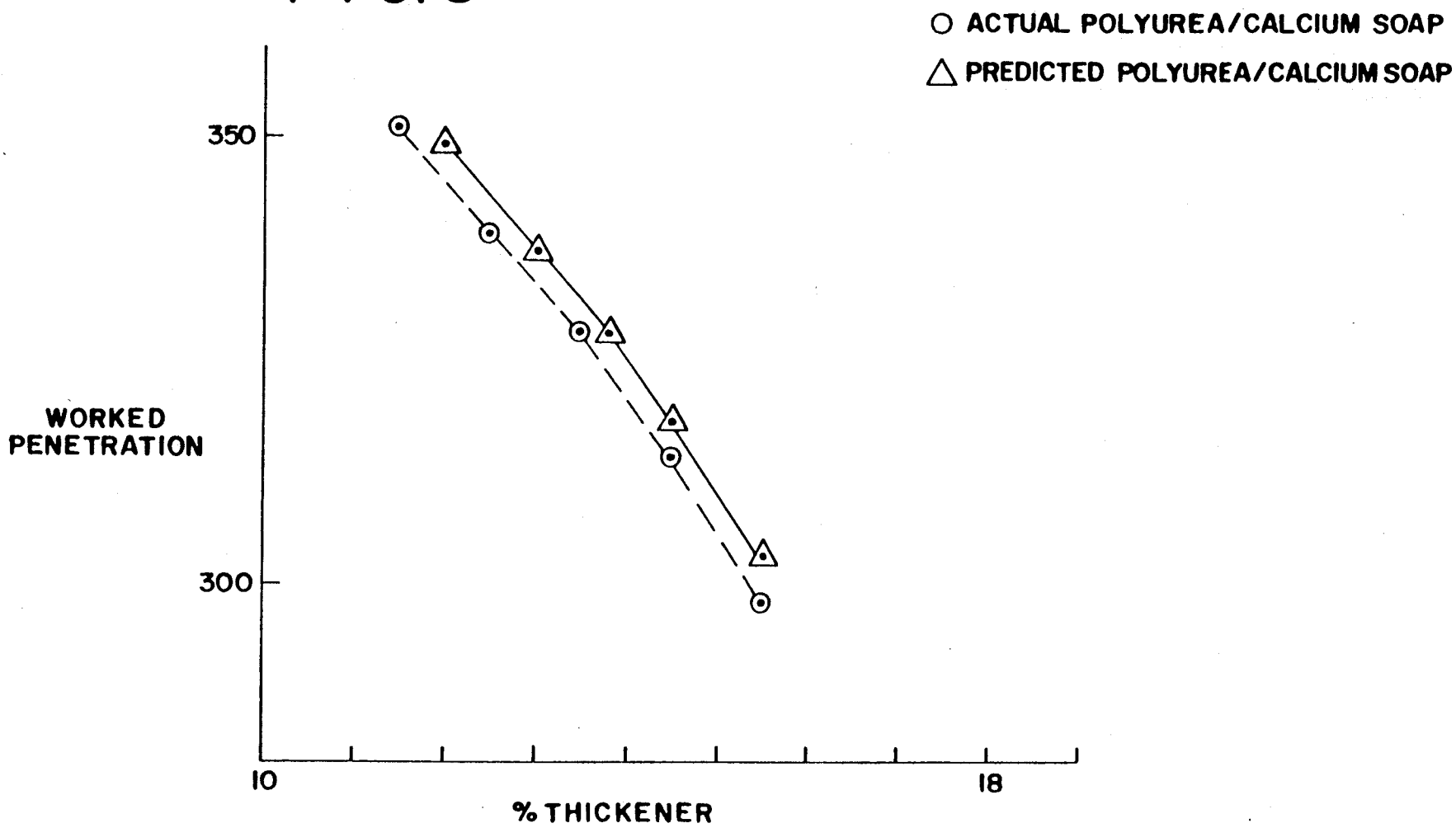
FIG. 5 is a chart of work penetration of actual and predicted polyurea and calcium soap thickened greases.

The graph (chart) of FIG. 5 illustrates in solid line the worked penetration of the polyurea/calcium soap greases of Examples 36–40 as a function of total thickener level. For comparison, FIG. 5 also shows in dotted line the theoretically predicted values of worked penetration as a function of total thickener level based on the results shown in FIG. 4. This theoretical plot can be considered as the predicted thickening power of the polyurea/calcium soap thickener system assuming that the individual polyurea and calcium complex soap components thicken the oil independently of each other. As can be seen from FIG. 5, the actual worked penetration and thickening power closely matches the predicted thickening power. This shows that the polyurea/calcium soap thickener of Examples 36–40 do not suffer from a severe loss of thickening power.

Advantageously, calcium soap thickeners are generally much less expensive on a per pound basis than are polyurea thickeners. This fact combined with the graphical evidence of FIG. 5 are important since they allow the grease formulator to take advantage of the demonstrated grease property improvements discussed in this patent application while simultaneously reducing the cost of the grease.

Comparison of the dropping points of Examples 25, 31, and 36 show a substantial improvement in dropping point in the polyurea/calcium soap thickened grease of Example 36 when compared to the dropping points of the grease of Example 31 thickened with only polyurea and the grease of Example 25 thickened with only calcium calcium complex soap. The dropping point of the calcium complex soap thickened grease of Example 25 was 638° F.; the dropping point of polyurea thickened Example 31 was 462° F. Therefore, the dropping point of the calcium complex soap thickened grease of Example 25 is elevated by 176° F. over the dropping point of the polyurea thickened grease of Example 31. The polyurea/ calcium soap thickened grease of Example 36 had a dropping point which was elevated by 172° F., 98% of the dropping point elevation of Example 25 over Example 31, even though only half the thickener of Example 36 was calcium complex soap.

The skin/age hardening of the polyurea/calcium soap thickened grease of Example 37 as shown by the change in unworked penetration also shows a substantial improvement when compared to the test results of the greases of Examples 27 and 32.

EXAMPLES 41–46

Another series six of polyurea/calcium soap thickened greases were made using portions of the base greases of Examples 2 and 9. Each of these six greases were made by a procedure similar to that of Example 15. The polyurea thickened base grease of Example 2 was chosen so as to demonstrate the benefits of the polyurea/calcium soap thickener system when using a polyurea thickener component which had not been high temperature heat treated. The amount of each base grease used was varied in the six greases to provide polyurea and calcium complex soap thickener levels which ranged from all polyurea thickened to all calcium complex soap thickened. Each grease was given three passes through a colloid mill with a gap clearance of 0.005 inch. The six greases were evaluated using several standard laboratory tests. Final grease compositions and test results are given below.

| | Examples | | | | |
|---|---|---|---|---|---|
| | 41 | 42 | 43 | 44 | 45 |
| Composition, % (wt) | | | | | |
| 850 SUS Oil | 44.14 | 44.78 | 45.41 | — | 48.18 |
| 350 SUS Oil | 29.42 | 29.85 | 30.28 | 31.90 | 32.12 |
| Polyurea | — | 4.00 | 7.50 | 8.25 | 10.50 |
| Calcium Complex Soap | 17.00 | 12.00 | 7.50 | 2.75 | — |
| Tricalcium Phosphate | 3.00 | 3.00 | 3.00 | 3.00 | 3.00 |
| Calcium Carbonate | 5.00 | 5.00 | 5.00 | 5.00 | 5.00 |

-continued

| | Examples | | | | |
|---|---|---|---|---|---|
| | 41 | 42 | 43 | 44 | 45 |
| Nasul BSN | 1.00 | 1.00 | 1.00 | 1.00 | 1.00 |
| Amoco 32 | 0.10 | 0.10 | 0.10 | 0.10 | 0.10 |
| Vanlube RD | 0.10 | 0.10 | 0.10 | 0.10 | 0.10 |
| Excess Calcium Hydroxide | 0.24 | 0.17 | 0.11 | 0.04 | — |
| Test Results | | | | | |
| Worked Penetration, ASTM D217 | 314 | 306 | 298 | 309 | 298 |
| Dropping Point, ASTM D2265, °F. | 500+ | 500+ | 500+ | 450 | 430 |
| Fretting Wear, ASTM D4170, 24 hr. mg loss/race set | 25.3 | 3.5 | 7.9 | 4.3 | 12.0 |

As can be seen from the data in Examples 41–46, the all polyurea thickened grease of Example 45 shows a lower dropping point compared to typical polyurea greases. This is a problem which can occur in some polyurea greases when the polyurea thickener is not high temperature heat treated. However, by using a polyurea/calcium soap thickener system the dropping point is substantially improved, even when the polyurea component was not high temperature heat treated. Examples 41–45 also demonstrate the surprising and unexpected improvement in fretting wear which was also shown in Examples 12–16. Since the only significant difference in Examples 41–45 is in the composition of the thickener system, the synergistic improvement in fretting wear was determined to be attributable to the novel thickener system.

EXAMPLE 47

To a two gallon steel can is added 1,073.09 grams of a polyurea thickened base grease having the same composition as that of Example 1. Also added to the steel can is 1,573.87 grams of the calcium 12-hydroxystearate thickened base grease of Example 11. The two base greases were stirred well by hand using a large steel spatula. To the stirred polyurea/calcium soap base grease was added: 54.48 grams of Irganox L-57, an octylated diphenylamine antioxidant available from Ciba Geigy Corporation; 90.80 grams of Nasul CA-HT, a calcium dinonylnaphthylene sulfonate and calcium tetraprophenylsuccinate blended rust inhibitor; 839.76 grams of 850 SUS Oil. The additives, oil, and polyurea/calcium soap base grease were well mixed by hand in the two gallon steel can. The mixture was then heated by placing the steel can with grease in a chamber maintained at 210° F. The grease was stirred by hand periodically until the grease temperature was 150° F. Then the polyurea/calcium soap grease was given one pass through a colloid mill with a gap setting of 0.001 inch. The weight ratio of polyurea to calcium soap in the final grease was 1:1.

EXAMPLE 48

To a two gallon steel can is added 1,126.75 grams of the same polyurea base grease used in Example 47. Also added to the steel can is 708.24 grams of the calcium 12-hydroxystearate thickened base grease of Example 11. The two base greases were stirred well by hand using a large steel spatula. To the stirred polyurea/calcium soap base grease was added: 40.86 grams of Irganox L-57, an octylated diphenylamine antioxidant available from Ciba Geigy Corporation; 68.10 grams of Nasul CA-HT, a calcium dinonylnaphtylene sulfonate and calcium tetrapropenylsuccinate blended rust inhibitor; 780.05 grams of 850 SUS Oil. The additives, oil, and polyurea/calcium soap base grease were well mixed by hand in the two gallon steel can. The mixture was then heated by placing the steel can with grease in a chamber maintained at 210° F. The grease was stirred by hand periodically until the grease temperature was 150° F. Then the polyurea/calcium soap grease was given one pass through a colloid mill with a gap setting of 0.001 inch. The weight ratio of polyurea to calcium soap in the final grease was 7:3.

The greases of Example 48 and Example 47 were evaluated by several standard test procedures. Final grease compositions and test results are given below.

| | Examples | |
|---|---|---|
| | 47 | 48 |
| Composition, % (wt) | | |
| 850 SUS Oil | 82.84 | 82.91 |
| Polyurea | 6.65 | 9.10 |
| Calcium 12-Hydroxystearate | 6.65 | 3.90 |
| Nasul CA-HT | 2.50 | 2.50 |
| Irganox L-57 | 1.50 | 1.50 |
| Vanlube 848 | 0.09 | 0.05 |
| Excess Calcium Hydroxide | 0.07 | 0.04 |
| Test Results | | |
| Penetration, ASTM D217 | | |
| Unworked | 260 | 284 |
| Worked 60 Strokes | 277 | 288 |
| Worked 10,000 Strokes | 290 | 316 |
| Worked 100,000 Strokes | 296 | 326 |
| Dropping Point, ASTM D2265, °F. | 456 | 478 |
| Oil Separation, SDM 433, % Loss | | |
| 24 hr, 212° F. | 0.2 | 1.6 |
| 24 hr, 300° F. | 6.9 | 8.9 |
| Corrosion Prevention Properties, ASTM D1743 | Pass 1 | Pass 1 |
| Roll Stability, ASTM D1831 | | |
| Worked Penetration (ASTM D1403) | | |
| Before Rolling | 270 | 301 |
| After Rolling | 287 | 318 |
| Points Change | +17 | +17 |
| % Change | +6.3 | +5.6 |
| Bomb Oxidation Stability, ASTM D942 | | |
| Pressure Change After 100 Hours, PSI | 2 | 1 |
| Pressure Change After 500 Hours, PSI | 10 | 8 |

As shown in the above data, the greases of Examples 47 and 48 have good dropping points, good protection against ferrous corrosion (rust), and excellent oxidation stability. The shear stability of the greases were also very good, much improved over results typical for polyurea thickened greases. The roll stability test results are particularly good. The grease of Example 48, which had the most polyurea relative to the total thickener, performed at least as good as did the grease of Example 47. On a percent change basis, the grease of Example 48 appeared actually somewhat superior in this regard.

EXAMPLE 49

A polyurea/calcium soap thickened grease was made by sequential formation of the two thickener components within the same grease kettle as follows. A polyurea thickened base grease was made as described in Example 6. After the 28.18 pounds of polyurea base grease had been removed, 6.67 pounds of 850 SUS oil was slowly added to the base grease remaining in the kettle to soften the grease in preparation of the formation of the calcium soap thickener and also to cool the grease. During the oil addition, the temperature dropped to 210° F. The grease was further cooled to 170° F. and 324.83 grams of hydrated lime was added and allowed to thoroughly mix into the grease. Then 589.19 grams of hydrogenated fatty acid and 199.41 grams of 12-hydroxystearic acid was added and allowed to react for 45 minutes while maintaining the temperature between 170° F. and 180° F. Reaction of the acids and hydrated lime proceeded very smoothly. Then 335.59 grams of glacial acetic acid was added and allowed to mix into the grease without additional external heating for 30 minutes.

The polyurea/calcium soap thickened grease was smooth and heavy in consistency. The kettle was closed and the grease was heated to 313° F. while maintaining a vacuum on the kettle contents. The grease was stirred under vacuum for one hour while maintaining the temperature between 315° F. and 325° F. Then the vacuum was released, the kettle was opened, and the following additives were added to the grease: precipitated tricalcium phosphate; precipitated calcium carbonate; Vanlube 848; and Nasul 727, a calcium dinonylnaphthylene sulfonate rust inhibitor available from R. T. Vanderbilt Company, Inc. The kettle was then closed, a vacuum was applied, and the grease with additives was stirred for one hour.

Thereafter, the vacuum was released and the grease was cooled to 250° F. The grease was then cyclically milled using a rotating knife-blade mill for 13 minutes. Additional 850 SUS oil and 350 SUS Oil was added to the grease which was then cooled to 170° F., milled with a Gaulin homogenizer at 7,000 psi, and stored for evaluation. The weight ratio of polyurea to calcium soap in the final grease was 7:3. Final grease composition and test results are given below.

| | Example 49 |
|---|---|
| Composition, % (wt) | |
| 850 SUS Oil | 48.11 |
| 350 SUS Oil | 32.07 |
| Polyurea | 8.05 |
| Calcium Complex Soap | 3.45 |
| Tricalcium Phosphate | 2.30 |
| Calcium Carbonate | 4.60 |
| Nasul 729 | 1.15 |
| Vanlube 848 | 0.23 |
| Excess Calcium Hydroxide | 0.04 |
| Test Results | |
| Worked Penetration, ASTM D217 | 320 |
| Dropping Point, ASTM D2265, °F. | 534 |
| Oil Separation, SDM 433, % Loss | |
| 24 hr, 212° F. | 5.0 |
| 24 hr, 300° F. | 7.0 |
| 24 hr, 350° F. | 7.2 |
| Panel Stability Test, 24 hr, 350° F. | No oil bleed. Remained grease-like. |

EXAMPLE 50

Another polyurea/calcium soap grease was made similar to that of Example 49. The polyurea and calcium soap thickeners were sequentially reacted in the same kettle in a manner similar to that previously described. The only major difference was in the relative amounts of polyurea and calcium soap thickener components in the final grease. This example had a weight ratio of polyurea to calcium soap of 1:1. Other aspects of heating, stirring, and milling were similar to Example 49. Panel stability tests were performed to determine if the polyurea/calcium soap thickened greases of Examples 49-50 exhibited any lacquer deposition characteristics. The Panel Stability test consists of spreading a 0.065 inch thick film of grease on a steel panel which is then bent, placed in an aluminum pan, and placed in an oven for the specified time and temperature. After the panel is removed and allowed to cool, the grease is evaluated for physical appearance and texture. Neither of the greases of Examples 49-50 showed any lacquer deposition characteristics. Other test results were very good. Final grease composition and test results are given below.

| | Example 50 |
|---|---|
| Composition, % (wt) | |
| 850 SUS Oil | 46.51 |
| 350 SUS Oil | 31.01 |
| Polyurea | 7.00 |
| Calcium Complex Soap | 7.00 |
| Tricalcium Phosphate | 2.33 |
| Calcium Carbonate | 4.67 |
| Nasul 729 | 1.17 |
| Vanlube 848 | 0.23 |
| Excess Calcium Hydroxide | 0.08 |
| Test Results | |
| Worked Penetration, ASTM D217 | 304 |
| Dropping Point, ASTM D2265, °F. | 521+ |
| Oil Separation, SDM 433, % Loss | |
| 30 hr, 212° F. | 2.4 |
| 30 hr, 300° F. | 2.9 |
| 30 hr, 350° F. | 2.6 |
| Four Ball Wear, ASTM D2266, mm | 0.47 |
| Four Ball EP, ASTM D2596 | |
| Last Nonseizure Load, Kg | 80 |
| Weld Load, Kg | 500 |
| Load Wear Index | 57.9 |
| Fretting Wear, ASTM D4170, 24 hr. mg loss/race set | 0.6 |
| Panel Stability Test, 24 hr, 350° F. | No oil bleed. Remained grease-like. |

Although the sequential reaction process demonstrated in Examples 49-50 used calcium complex type soap thickeners, it will be apparent to those skilled in the art that my process and quantities obtained from my blended thickener system are also applicable to a blend of polyurea and simple calcium soap. In this respect, before the addition of glacial acetic acid, the calcium soap component present in the grease kettle was of the simple calcium soap type. Had the glacial acetic acid not been added, and had a chemically equivalent amount of 12-hydroxystearic acid been added instead, the resulting polyurea/calcium soap thickener systems for Examples 49 and 50 would have been similar in composition and properties to the polyurea/calcium soap thickener systems of 48 and 47, respectively.

Among the many advantages of the novel polyurea/calcium soap thickener systems and the greases with which they are thickened are:

1. Greatly improved dropping point.
2. Significantly improved oil separation over a wide range of temperatures.
3. Superior thickening power compared with prior-art complex soap thickeners.
4. Vastly, improved thickening power when using higher throughput milling devices such as colloid mills.
5. Excellent skin/age hardening properties.
6. Elimination of high temperature lacquer deposition characteristics.
7. Lower maximum polyurea heat treatment temperatures without adverse effects of final grease properties such as oil separation and thickening power.
8. Decreased maximum manufacturing temperatures without adverse effects on properties such as dropping point, oil separation, and thickening power.
9. Improved fretting wear protection.
10. Enhanced shear stability.
11. Better flexibility of composition and resulting rheological properties.
12. Good adaptability of manufacturing equipment requirements.
13. Can be used with most commonly used lubricant additives.
14. Compatible with polyurea thickened greases and with calcium soap thickened greases.
15. Easily adaptable to product slates of grease manufacturing plants which already make polyurea and calcium soap thickened greases.
16. Provides high performance levels at lower cost.
17. Nontoxic.
18. Safe.
19. Economical.
20. Effective.

Although embodiments of this invention have been shown and described, it is to be understood that various modifications and substitutions can be made by those skilled in the art without departing from the novel spirit and scope of this invention.

What is claimed is:

1. A lubricating grease, comprising:
a base oil;
an additive package;
a urea-containing thickener selected from the group consisting of monourea, diurea, and polyurea; and
a calcium-containing thickener selected from the group consisting of simple calcium soap and calcium complex soap.

2. A lubricating grease in accordance with claim 1 wherein said base oil comprises a member selected from the group consisting of naphthenic oil, paraffinic oil, aromatic oil, and a synthetic oil, said synthetic oil comprising a member selected from the group consisting of a polyalphaolefin, a polyester, a polyolester, a diester, a polyether, a polyolether, and fluorinated compounds thereof.

3. A lubricating grease in accordance with claim 1 wherein said base oil comprises a mixture of two different refined, solvent-extracted, hydrogenated, dewaxed base oils.

4. A lubricating grease in accordance with claim 1 wherein said base oil comprises about 60% by weight of a 850 SUS refined solvent-extracted hydrogenated dewaxed base oil and about 40% by weight of a 350 SUS refined solvent-extracted hydrogenated dewaxed base oil.

5. A lubricating grease in accordance with claim 1 wherein said calcium-containing thickener comprises an anhydrous simple calcium soap.

6. A lubricating grease in accordance with claim 1 wherein said calcium-containing thickener comprises a calcium carboxylate thickener.

7. A lubricating grease in accordance with claim 1 wherein said calcium-containing thickener comprises a reaction product of a calcium base material selected from the group consisting of calcium oxide, calcium carbonate, calcium bicarbonate, and calcium hydroxide and a monocarboxylic acid selected from the group consisting of 12-hydroxystearic acid, 14-hydroxystearic acid, 16-hydroxystearic acid, 6-hydroxystearic acid, and 9,10-dihydroxystearic acid.

8. A lubricating grease, comprising:
at least one base oil; and
from about 6% to about 20% by weight of a blended thickener system comprising polyurea and calcium soap.

9. A lubricating grease in accordance with claim 8 containing from about 10% to about 16% by weight of said blended thickener system.

10. A lubricating grease in accordance with claim 8 wherein said calcium soap comprises simple calcium soap.

11. A lubricating grease in accordance with claim 8 wherein said calcium soap comprises calcium complex soap.

12. A lubricating grease, comprising:
at least about 70% by weight base oil;
from about 6% to about 20% by weight additives; and
from about 10% to about 16% by weight of a polyurea and calcium complex soap thickener comprising both polyurea and calcium complex soap.

13. A lubricating grease in accordance with claim 12 wherein said thickener comprises from about 40% to about 60% by weight polyurea and from about 40% to about 60% by weight calcium complex soap.

* * * * *

UNITED STATES PATENT AND TRADEMARK OFFICE

CERTIFICATE OF CORRECTION

PATENT NO. : 5,084,193
DATED : January 28, 1992
INVENTOR(S) : John Andrew Waynick It is certified that error appears in the above-indentified patent and that said Letters Patent is hereby corrected as shown below:

Column 8, line 45, "ad" should read -- and --.

Column 18, line 29, "silixane" should read -- siloxane--.

Column 26, line 3, "grease" should read -- greases--.

Signed and Sealed this

Twenty-eighth Day of September, 1993

Bruce Lehman

*Attest:*

BRUCE LEHMAN

*Attesting Officer*

*Commissioner of Patents and Trademarks*